US007828491B2

(12) United States Patent
Cheng

(10) Patent No.: US 7,828,491 B2
(45) Date of Patent: Nov. 9, 2010

(54) TRAVEL BAR FOR USE WITH A RING MECHANISM

(75) Inventor: Hung Y. Cheng, Hong Kong (CN)

(73) Assignee: World Wide Stationery Mfg. Co., Ltd., Kwai Chung, New Territory (HK)

( * ) Notice: Subject to any disclaimer, the term of this patent is extended or adjusted under 35 U.S.C. 154(b) by 1113 days.

(21) Appl. No.: 11/208,951

(22) Filed: Aug. 22, 2005

(65) Prior Publication Data

US 2006/0251467 A1 Nov. 9, 2006

Related U.S. Application Data

(60) Provisional application No. 60/678,394, filed on May 6, 2005.

(51) Int. Cl.
*B42F 13/02* (2006.01)

(52) U.S. Cl. ..... 402/19; 402/36; 402/38

(58) Field of Classification Search ..... 402/19, 402/26–45, 70, 73, 80 R; D19/26–27, 32
See application file for complete search history.

(56) References Cited

U.S. PATENT DOCUMENTS

| | | | | |
|---|---|---|---|---|
| 419,160 | A | 1/1890 | Smith | |
| 566,717 | A | 8/1896 | Krah | |
| 621,256 | A | 3/1899 | Krah | |
| 651,254 | A | 6/1900 | Krah | |
| 683,019 | A | 9/1901 | Buchanan | |
| 779,879 | A | 1/1905 | Sheridan | |
| 790,382 | A | 5/1905 | McBride | |
| 854,074 | A * | 5/1907 | Bryant | 402/41 |
| 857,377 | A | 6/1907 | Baker | |
| 974,831 | A | 11/1910 | Scherzinger | |
| 1,011,391 | A | 12/1911 | Sturgis | |
| 1,163,179 | A | 12/1915 | Schade | |
| 1,168,260 | A | 1/1916 | Albrecht | |

(Continued)

FOREIGN PATENT DOCUMENTS

DE 10119121 A1 10/2001

(Continued)

OTHER PUBLICATIONS

Response filed Jul. 17, 2008 to Office Action dated Apr. 25, 2008 from related U.S. Appl. No. 11/157,622, 14 pgs.

(Continued)

*Primary Examiner*—Dana Ross
*Assistant Examiner*—Matthew G Katcoff
(74) *Attorney, Agent, or Firm*—Senniger Powers LLP

(57) ABSTRACT

A ring mechanism for retaining loose-leaf pages has supporting hinge plates for pivoting motion relative to a housing to open and close ring members. The mechanism further includes a thin, flat travel bar between the housing and the hinge plates. The travel bar moves relative to the hinge plates between a position blocking the hinge plates against pivoting when the ring members are closed and a position allowing the hinge plates to pivot when it is desired to open the ring members. The travel bar is supported in a generally vertical orientation by the hinge plates within a guide in the housing. The guide controls movement of the travel bar lengthwise of the housing.

20 Claims, 36 Drawing Sheets

U.S. PATENT DOCUMENTS 1,398,034 A 11/1921 Mero
1,398,388 A 11/1921 Murphy
1,598,206 A 8/1926 Lindstedt
1,733,548 A 10/1929 Martin
1,733,894 A 10/1929 Martin
1,787,957 A 1/1931 Schade
1,822,669 A 9/1931 Schade
1,824,791 A 9/1931 Rengmann
1,857,291 A 5/1932 Trussell
1,953,981 A 4/1934 Trussell
1,991,362 A 2/1935 Krag
1,996,463 A 4/1935 Dawson
2,004,570 A 6/1935 Dawson
2,013,416 A 9/1935 McClure
2,024,461 A 12/1935 Lotter
2,067,846 A 1/1937 Cooper
2,075,766 A 3/1937 Rand
2,075,767 A 3/1937 Rand
2,081,372 A 5/1937 Thomas
2,089,211 A 8/1937 Krag
2,096,944 A 10/1937 Unger
2,103,307 A 12/1937 Unger
2,105,235 A 1/1938 Schade
2,158,056 A 5/1939 Cruzan
2,179,627 A 11/1939 Handler
2,204,918 A 6/1940 Trussell
2,218,105 A 10/1940 Griffin
2,236,321 A 3/1941 Ostrander
2,239,062 A 4/1941 Tallmadge
2,239,121 A 4/1941 Louis
2,251,878 A 8/1941 Hanna
2,252,422 A 8/1941 Unger
2,260,929 A 10/1941 Bloore
2,288,189 A 6/1942 Guinane
2,304,716 A 12/1942 Supin
2,311,492 A 2/1943 Unger
2,322,595 A 6/1943 Schade
2,338,011 A * 12/1943 Schade ..... 402/21
2,421,799 A 6/1947 Martin
2,528,866 A 11/1950 Dawson
2,543,866 A 3/1951 Panfil
2,552,076 A 5/1951 Wedge
2,570,323 A 10/1951 Condon
2,612,169 A 9/1952 Segal
2,789,561 A 4/1957 Bonn
2,865,377 A 12/1958 Schroer
2,871,711 A 2/1959 Stark
2,891,553 A 6/1959 Acton
2,894,513 A 7/1959 Gempe
3,077,888 A 2/1963 Thieme
3,098,489 A 7/1963 Vernon
3,098,490 A 7/1963 Wance
3,101,719 A 8/1963 Vernon
3,104,667 A 9/1963 Mintz
3,149,636 A 9/1964 Rankin
3,190,293 A 6/1965 Schneider
3,205,894 A 9/1965 Rankin
3,205,895 A 9/1965 Johnson
3,255,759 A 6/1966 Dennis
3,348,550 A 10/1967 Wolf
3,718,402 A 2/1973 Schade
3,748,051 A 7/1973 Frank
3,884,586 A 5/1975 Michaelis
3,954,343 A 5/1976 Thomsen
3,993,374 A 11/1976 Schudy et al.
4,127,340 A 11/1978 Almgren
4,130,368 A 12/1978 Jacoby et al.
4,352,582 A 10/1982 Eliasson
4,486,112 A 12/1984 Cummins
4,522,526 A 6/1985 Lozfau
4,566,817 A 1/1986 Barrett, Jr.
4,571,108 A 2/1986 Vogl
4,696,595 A 9/1987 Pinkney
4,798,491 A 1/1989 Lassle
4,813,803 A 3/1989 Gross
4,815,882 A 3/1989 Ohminato
4,886,390 A 12/1989 Silence
4,919,557 A 4/1990 Podosek
5,067,840 A 11/1991 Cooper
5,116,157 A 5/1992 Gillum
5,135,323 A 8/1992 Pinheiro
5,180,247 A 1/1993 Yu
5,255,991 A 10/1993 Sparkes
5,286,128 A 2/1994 Gillum
5,332,327 A 7/1994 Gillum
5,346,325 A 9/1994 Yamanoi
5,354,142 A * 10/1994 Yu ..... 402/41
5,368,407 A 11/1994 Law
5,378,073 A 1/1995 Law
5,393,155 A 2/1995 Ng
5,393,156 A 2/1995 Mullin et al.
5,476,335 A 12/1995 Whaley
5,524,997 A 6/1996 von Rohrscheidt
5,577,852 A 11/1996 To
5,651,628 A 7/1997 Bankes
5,660,490 A * 8/1997 Warrington ..... 402/36
5,692,847 A 12/1997 Zane
5,692,848 A 12/1997 Wada
5,718,529 A 2/1998 Chan
5,782,569 A 7/1998 Mullin et al.
5,788,392 A 8/1998 Cheung
5,807,006 A 9/1998 Cheung
5,810,499 A 9/1998 Law
5,816,729 A 10/1998 Whaley
5,836,709 A 11/1998 Cheung
5,868,513 A 2/1999 Law
5,879,097 A 3/1999 Cheng
5,882,135 A 3/1999 Ko
5,895,164 A * 4/1999 Wu ..... 402/36
5,924,811 A 7/1999 To
5,957,611 A 9/1999 Whaley
5,975,785 A * 11/1999 Chan ..... 402/36
6,036,394 A 3/2000 Cheng
6,142,697 A * 11/2000 Williams ..... 402/31
6,146,042 A 11/2000 To et al.
6,155,737 A 12/2000 Whaley
6,203,229 B1 3/2001 Coerver
6,206,601 B1 3/2001 Ko
6,217,247 B1 4/2001 Ng
6,270,279 B1 8/2001 Whaley
6,276,862 B1 8/2001 Snyder et al.
6,293,722 B1 9/2001 Holbrook et al.
6,364,558 B1 4/2002 To
6,371,678 B1 4/2002 Chizmar
6,467,984 B1 10/2002 To
6,474,897 B1 11/2002 To
6,533,486 B1 3/2003 To
6,749,357 B2 6/2004 Cheng
6,758,621 B2 7/2004 To
6,821,045 B2 11/2004 Whaley
6,840,695 B2 1/2005 Horn
6,916,134 B2 7/2005 Wong
7,296,946 B2 11/2007 Cheng
2003/0044221 A1 3/2003 To
2003/0103797 A1 6/2003 Cheng
2003/0103798 A1 6/2003 Cheng et al.
2003/0123923 A1 7/2003 Koike et al.
2005/0013654 A1 1/2005 Cheng et al.
2005/0201817 A1 9/2005 Cheng
2005/0201818 A1 9/2005 Cheng
2005/0201819 A1 9/2005 Cheng
2005/0201820 A1 9/2005 Ng
2005/0207826 A1 9/2005 Cheng
2005/0214064 A1 9/2005 Ng

| | | | |
|---|---|---|---|
| 2005/0232689 | A1 | 10/2005 | Cheng |
| 2006/0008318 | A1 | 1/2006 | Ng |
| 2006/0056906 | A1 | 3/2006 | Horn |
| 2006/0088365 | A1 | 4/2006 | Whaley |
| 2006/0147253 | A1 | 7/2006 | Cheng |
| 2006/0147254 | A1 | 7/2006 | Cheng |
| 2006/0147255 | A1 | 7/2006 | Cheng |
| 2006/0153628 | A1 | 7/2006 | Tanaka |
| 2006/0153629 | A1 | 7/2006 | Cheng |
| 2006/0216107 | A1 | 9/2006 | Lin |
| 2006/0228164 | A1 | 10/2006 | Horn |
| 2006/0251468 | A1 | 11/2006 | Cheng |
| 2007/0086836 | A1 | 4/2007 | Cheng |

FOREIGN PATENT DOCUMENTS

| | | | |
|---|---|---|---|
| EP | 1316438 | A1 | 6/2003 |
| EP | 1323545 | A2 | 7/2003 |
| EP | 1431065 | A2 | 6/2004 |
| FR | 1 336 765 | | 9/1963 |
| FR | 1336765 | | 9/1963 |
| FR | 1 346 864 | A | 12/1963 |
| FR | 1346864 | | 12/1963 |
| FR | 2221924 | | 10/1974 |
| FR | 2 238 332 | A | 2/1975 |
| FR | 2238332 | | 2/1975 |
| GB | 868724 | | 5/1961 |
| GB | 906279 | | 9/1962 |
| GB | 952536 | | 3/1964 |
| GB | 2231536 | A | 11/1990 |
| GB | 2251215 | A | 7/1992 |
| GB | 2275023 | A | 8/1994 |
| GB | 2292343 | A | 2/1996 |
| GB | 2387815 | A | 10/2003 |
| JP | 5979379 | | 5/1984 |
| JP | 6118880 | | 2/1986 |
| JP | 62189178 | | 12/1987 |
| JP | 01299095 | A | 12/1989 |
| JP | 2-34289 | U | 3/1990 |
| JP | 4120085 | | 10/1992 |
| JP | 10217662 | | 8/1998 |
| JP | 2004098417 | A | 4/2004 |
| WO | 0119620 | A1 | 3/2001 |
| WO | WO 01/19620 | A1 | 3/2001 |
| WO | 0181099 | A1 | 11/2001 |

OTHER PUBLICATIONS

Office Action dated Apr. 25, 2008 in related U.S. Appl. No. 11/157,622.

Response filed Jan. 15, 2009 to Office action dated Oct. 23, 2008 from related U.S. Appl. No. 11/157,622, 11 pgs.

Office Action dated Oct. 23, 2008 from related U.S. Appl. No. 11/157,622, 12 pages.

Kokuyo Lock Ring Mechanism with description, two instruction sheets, and nine photographs, undated but admitted as prior art, 12 pgs.

Office action issued May 1, 2009 from related U.S. Appl. No. 11/157,622, 10 pgs.

Response filed Sep. 11, 2009 to Office Action dated May 1, 2009 from related U.S. Appl. No. 11/157,622, 12 pgs.

* cited by examiner

TRAVEL BAR FOR USE WITH A RING MECHANISM

CROSS REFERENCE TO RELATED APPLICATION

This application claims the benefit of U.S. Provisional Application No. 60/678,394, filed May 6, 2005, and entitled A Travel Bar For Use With A Ring Binder Mechanism, the entire disclosure of which is hereby incorporated by reference.

BACKGROUND OF THE INVENTION

This invention relates generally to a ring mechanism for retaining loose-leaf pages and, more particularly, to an improved mechanism for opening and closing ring members and for locking closed ring members together.

A ring mechanism typically retains loose-leaf pages, such as hole-punched papers, in a file or notebook. A pair of hinge plates are supported within a housing in joined relation for loose pivoting motion relative to the housing. The housing is generally narrower than the joined hinge plates when they are in a coplanar position (180°). So as the hinge plates pivot through the coplanar position, they deform the housing and cause a spring force that urges them to pivot either upward or downward. Ring members mounted on the hinge plates move with the pivoting movement of the hinge plates. The ring members open when the hinge plates pivot upward and close when the hinge plates pivot downward.

Some ring mechanisms include structure (e.g., control slides) located between the housings and the hinge plates to lock the ring members together when they close. The control slides engage upper surfaces of the hinge plates and block the hinge plates from pivoting upward when it is desired to hold the closed ring members together. The control slides move out of engagement with the hinge plates and allow the hinge plates to pivot freely when it is desired to open the ring members. These control slides, however, may have complex shapes or unique parts in order to allow them to interact with the hinge plates to block or allow the pivoting movement of the hinge plates. Therefore, they may be harder to fabricate or may require multiple components for proper operation (e.g., a travel bar and separate blocking elements). Thus, ring mechanisms incorporating these known control slides can be time consuming and costly to produce.

Accordingly, it would be desirable to provide a ring mechanism that is easy to make and that includes a simplified travel bar.

SUMMARY OF THE INVENTION

In one aspect, the present invention is directed to a ring mechanism for retaining loose-leaf pages. The mechanism generally comprises a housing having a longitudinal axis, a top portion and an open bottom generally opposed to the top portion. Hinge plates are supported by the housing for pivoting movement relative to the housing. Each ring for holding loose-leaf pages includes a first ring member and a second ring member. The first ring member is mounted on a first hinge plate and moveable with the pivoting motion of the first hinge plate relative to the second ring member between a closed position and an open position. In the closed position the two ring members form a substantially continuous, closed loop for allowing loose-leaf pages retained by the rings to be moved along the rings from one ring member to the other. In the open position the two ring members form a discontinuous, open loop for adding or removing loose-leaf pages from the rings. A thin, flat travel bar includes a major surface lying generally in a plane parallel to or coincident with a plane including the longitudinal axis of the housing and intersecting the top portion and open bottom of the housing.

In another aspect, a ring mechanism generally comprises a housing having a guide. Hinge plates are supported by the housing for pivoting movement relative to the housing. The hinge plates pivot through a co-planar position. Each ring for holding loose-leaf pages includes a first ring member and a second ring member. The first ring member is mounted on a first hinge plate and moveable with the pivoting motion of the first hinge plate relative to the second ring member between a closed position and an open position. In the closed position the two ring members form a substantially continuous, closed loop for allowing loose-leaf pages retained by the rings to be moved along the rings from one ring member to the other. In the open position, the two ring members form a discontinuous, open loop for adding or removing loose-leaf pages from the rings. A travel bar is restrained by the guide for movement relative to the housing.

In yet another aspect, a ring mechanism generally comprises a housing, and hinge plates supported by the housing for pivoting movement relative to the housing. Each ring, for holding loose-leaf pages, includes a first ring member and a second ring member. The first ring member is mounted on a first hinge plate and moveable with the pivoting motion of the first hinge plate relative to the second ring member between a closed position and an open position. In the closed position, the two ring members form a substantially continuous, closed loop for allowing loose-leaf pages retained by the rings to be moved along the rings from one ring member to the other. In the open position, the two ring members form a discontinuous, open loop for adding or removing loose-leaf pages from the rings. An actuator is supported by the housing and has a back side generally facing away from the housing. A spring engageable with the back side of the actuator biases the actuator.

BRIEF DESCRIPTION OF THE DRAWINGS

Corresponding reference characters indicate corresponding parts throughout the several views of the drawings.

DETAILED DESCRIPTION

Figure 1:
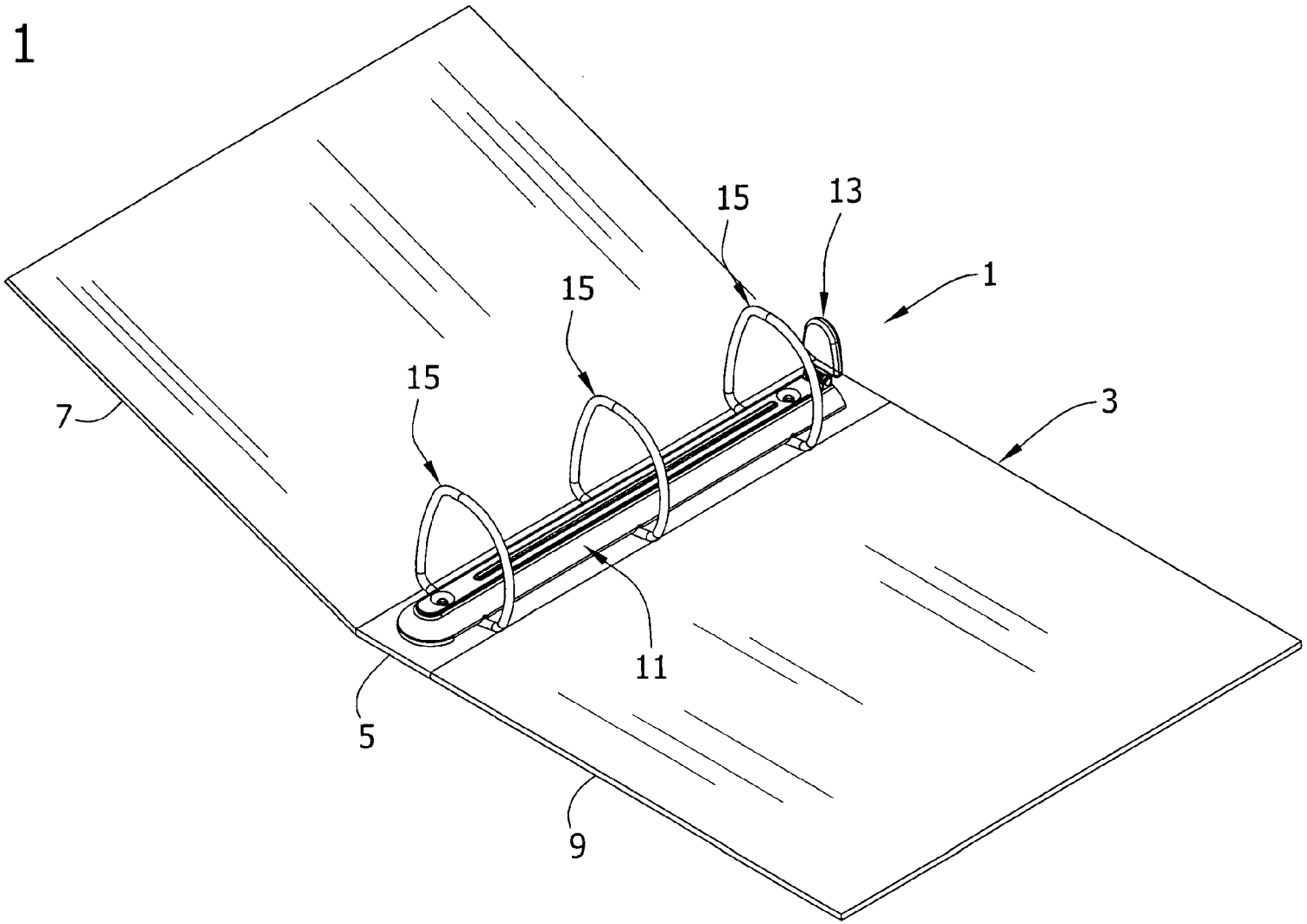
FIG. 1 is a perspective of a notebook incorporating a ring mechanism according to a first embodiment of the invention.

Referring now to the drawings, FIGS. 1-12 show a ring mechanism according to a first embodiment of the invention generally at 1. The mechanism is shown in FIG. 1 mounted on a notebook, indicated generally at 3. In particular, it is shown mounted on a spine 5 of the notebook 3 between a front cover 7 and a back cover 9. The front and back covers are hingedly attached to the spine 5 for moving to selectively cover or expose loose-leaf pages (not shown in the drawings) retained by the mechanism 1. A ring mechanism mounted on a surface other than a notebook, for example a file, does not depart from the scope of this invention.

The terms "forward" and "rearward" are used herein for convenience to describe relative orientation of components of ring mechanism 1. "Forward" refers to the left of the ring mechanism 1 as viewed in FIG. 1 and "rearward" refers to the right of the ring mechanism. These terms do not limit the invention in any way. Similarly, the terms "vertical" and "horizontal" may be used for convenience to describe the orientation of parts when the ring mechanism 1 and cover 3 are laid open flat on the horizontal surface of a table. However, these terms do not limit the invention to having any particular orientation.

Figure 4:
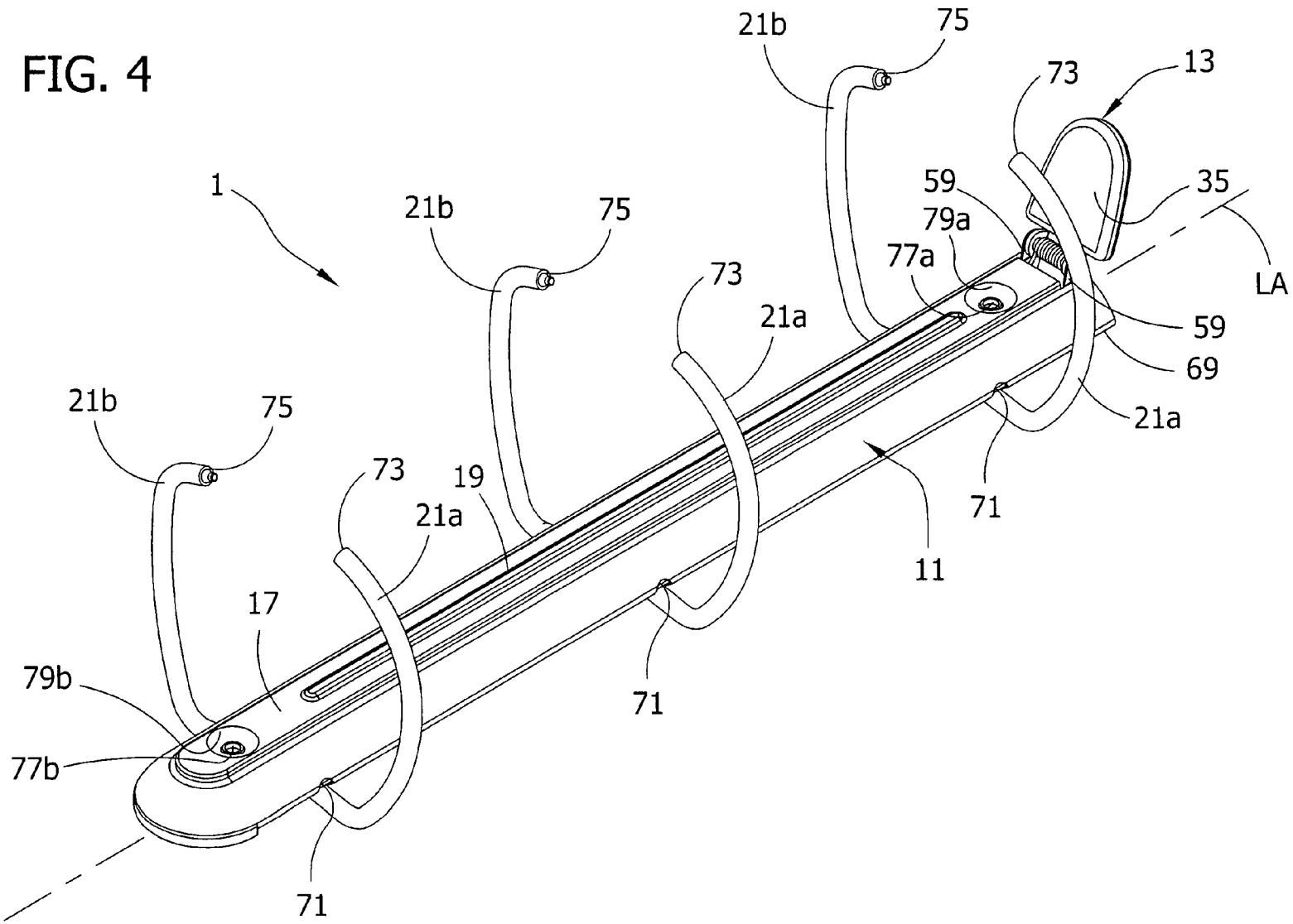
FIG. 4 is a top side perspective of the ring mechanism with ring members in an open position.

As shown in FIGS. 1-4, the ring mechanism 1 generally includes a housing indicated generally at 11, a lever indicated generally at 13 (broadly, an "actuator"), and three rings, each indicated generally at 15. As is generally known in the art, the housing 11 supports the lever 13 and rings 15 for operation of the rings between a closed position (FIGS. 1-3) and an open position (FIG. 4). In the closed position, the rings 15 form a continuous, closed, D-shaped loop (FIG. 3) for retaining loose-leaf pages. In the open position, the rings 15 form a discontinuous, open loop for adding or removing pages. A ring mechanism with more or fewer than three rings, or with rings that form a different shape (e.g., a circular shape) when in a closed position does not depart from the scope of this invention.

Referring to FIGS. 2-5, the housing 11 is elongate with a longitudinal axis LA and a uniform, generally arch-shaped cross section having at its center a raised plateau 17. The plateau includes a longitudinal channel 19, or guide, projecting up from the plateau 17 and extending a substantial part of the length of the housing 11. The longitudinal channel 19 will be described in greater detail with regard to operation of the ring mechanism 1. It is understood that the housing plateau 17 could be omitted. For example, the upper surface of the housing 11 could be rounded, with the housing channel 19 elevated above the rounded upper surface.

The rings 15 each include first and second separable ring members 21*a*, 21*b* moveable relative to each other between the closed position and the open position of the rings 15. The first ring members 21*a* are each positioned relatively toward the bottom of the ring mechanism 1 in FIGS. 2, 4, and 5 and have roughly semi-circular, C-shaped profiles. The second ring members 21*b* are each positioned relatively toward the top of the mechanism 1 in these figures and have more squared-off, half box-shaped profiles such as is common for D-rings. This is also shown in the section view of FIG. 3 where the first ring member 21*a* is on the left of the mechanism 1 and the second ring member 21*b* is on the right. It is envisioned that the ring members 21*a*, 21*b* are formed from a conventional, cylindrical rod of a suitable material such as steel. But ring members having different cross-sections or formed from different materials do not depart from the scope of the invention.

Free ends 73, 75 of respective ring members 21*a*, 21*b* are shown with mating structure capable of securely holding the ring members together against misalignment when in the closed position of the rings 15. In the illustrated mechanism 1, the free end 75 of each of the second ring members 21*b* is formed as a convex projection (FIG. 4) and the free end 75 of each of the first ring members 21*a* is formed as a concave bore (FIG. 12) sized to receive the convex projection. It is understood that a ring mechanism with ring members having different free end mating structures to securely hold closed ring members together (or no such structures) does not depart from the scope of the invention.

Figure 5:
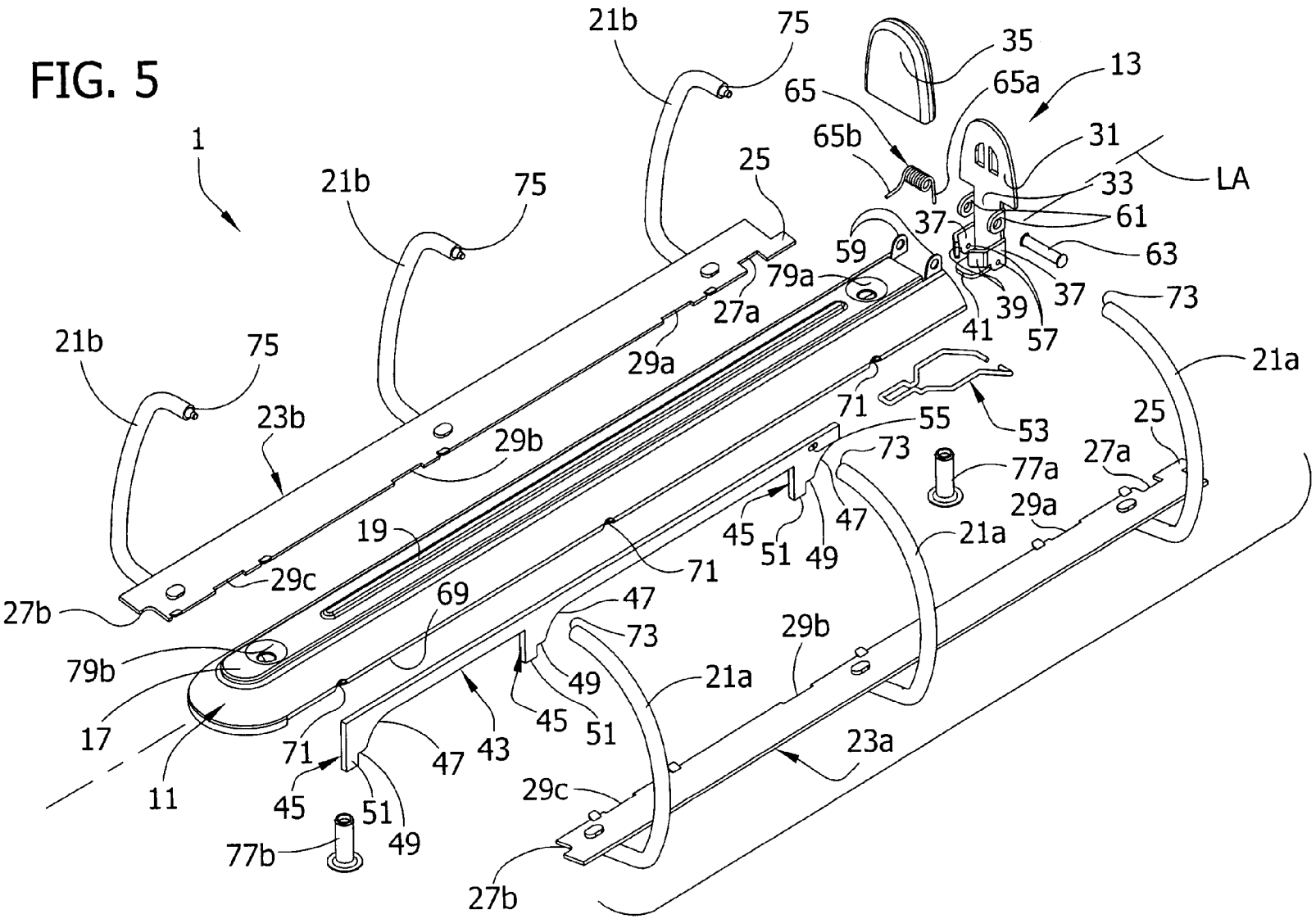
FIG. 5 is an exploded perspective of the ring mechanism.

Referring now to FIG. 5, the ring members 21*a*, 21*b* are shown each mounted on one of two mirror image hinge plates indicated generally at 23*a*, 23*b*. The first ring member 21*a* of each ring 15 mounts on a first hinge plate 23*a*, and the second ring member 21*b* of each ring mounts on a second hinge plate 23*b*. In the illustrated mechanism 1, the ring members 21*a*, 21*b* are mounted on a lower surface of each hinge plate 23*a*, 23*b* as is common in the art. A ring mechanism with only one ring member of each ring mounted on a hinge plate and the other ring member mounted, for example, on a housing is within the scope of this invention.

The hinge plates 23*a*, 23*b* are each thin and generally rectangular in shape, and each have opposite longitudinal ends and opposite longitudinal edge margins. A rearward end of each hinge plate 23*a*, 23*b* includes a finger 25 extending longitudinally away from the plate. The finger 25 is somewhat narrower than the rest of the hinge plate 23*a*, 23*b* and is aligned generally with an inner longitudinal edge margin of the plate. Each hinge plate 23*a*, 23*b* also includes two mounting post cutouts 27*a*, 27*b* and three locking element cutouts 29*a-c* along its inner longitudinal edge margin. The mounting post cutouts 27*a*, 27*b* are located toward opposite ends of the hinge plates 23*a*, 23*b* while the locking element cutouts 29*a-c* are located in spaced apart relation inward and between the mounting post cutouts. The cutouts 27*a*, 27*b*, 29*a-c* will be described in greater detail hereinafter.

FIG. 5 also illustrates the lever 13 of the ring mechanism 1. The lever 13 includes an enlarged mushroom-shaped head 31 and a narrow stem-shaped body 33. The head 31 and body 33 are both generally flat and lie in a common plane, with the head extending longitudinally away from a top end of the body. In the illustrated ring mechanism 1, the head 31 is integral with the body 33. But the two may be formed separately and attached together within the scope of the invention. A lever cover 35 fits over the lever head 31 to facilitate comfortably gripping and applying force to the lever 13. It is envisioned that the cover 35 is formed from a plastic or rubber material, but may be formed from any acceptable material.

The lever 13 also includes closing and opening structure which, as will be described, allow it to interact with the hinge plates 23*a*, 23*b* to move the ring members 21*a*, 21*b* between the closed and open positions. The closing structure comprises two mirror image, spaced apart closing arms, each designated 37. The closing arms 37 each extend forward from opposite lateral sides of the lever body 33 and each have narrowed ends indicated at 39, bent inward and toward each other. The narrowed ends 39 are generally taller than they are thick so that the arms 37 are reinforced against bending during operation of the ring mechanism 1. In use, the closing arms 37 engage respective ones of the hinge plate fingers 25 for moving the hinge plates 23*a*, 23*b* to the closed position. The opening structure of the lever 13 comprises a flat opening arm 41 below the two closing arms 37. The opening arm 41 is located at a bottom end of the body 33 and is about as thick as each of the two closing arms 37. The opening arm 41 extends forward from the body 33 about the same distance as the closing arms and at an angle of about 90° relative to the body in spaced apart relation with the narrowed ends 39 of the two closing arms 37. In use, the opening arm 41 engages the fingers 25 of the hinge plates 231, 23*b* to move the hinge plates to the open position.

Figure 6:
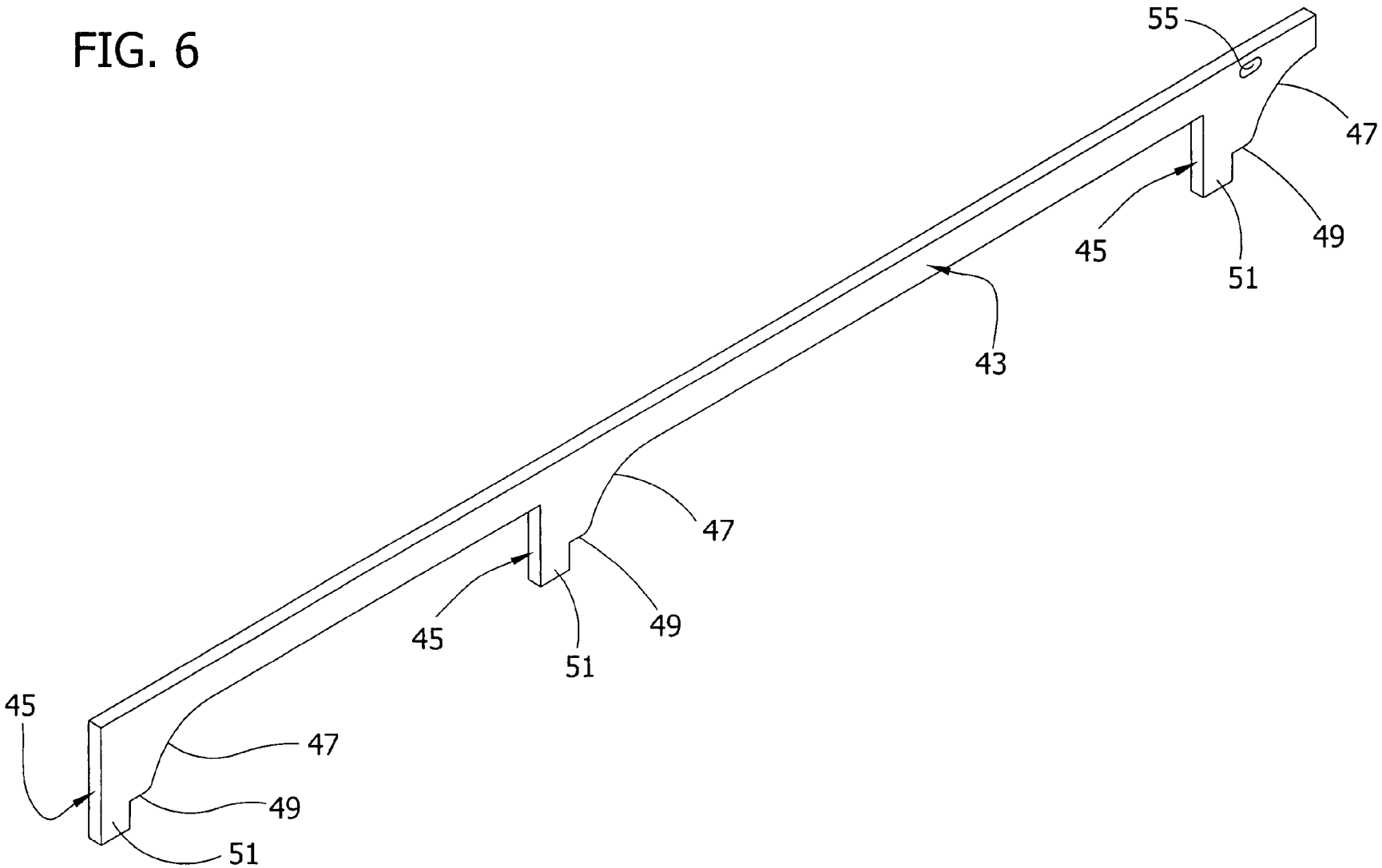
FIG. 6 is an enlarged perspective of a travel bar of the ring mechanism.

FIGS. 5 and 6 show a travel bar of the ring mechanism 1 generally at 43 for use in locking the ring members 21*a*, 21*b* together when they are closed, as will be described. The travel bar 43 is thin and flat in shape and is oriented in a substantially vertical plane as illustrated in the drawings. It includes a flat upper edge and a shaped lower edge. The shaped lower edge includes three integral, inverted L-shaped projections, or locking elements each indicated generally at 45, extending downward from the travel bar 43 within the plane of the travel bar. Each locking element 45 is spaced apart longitudinally along the travel bar 43 with one locking element 45 located adjacent each longitudinal end of the travel bar 43 and one located therebetween toward a center of the travel bar. The locking elements 45 are each similar in shape and each include an arcuate rearward edge 47, a flat shoulder 49, and a lower arm 51. The locking elements 45 will be described in greater detail with regard to operation of the ring mechanism 1.

The travel bar 43 and integral locking elements 45 are formed in a single step. They are formed by stamping a sheet of metal to the desired form (FIG. 6). Subsequent steps of forming locking elements on a travel bar (e.g., as by bending a travel bar) or connecting separately formed locking elements to a travel bar are not required. It is envisioned that multiple travel bars can be made by feeding a sheet of material (e.g., metal) through a machine where preformed dies repeatedly stamp multiple travel bars at once from the sheet. It is understood that the machine and the dies may be formed in a suitable manner, such as is known in the art. It is submitted that this process of forming travel bars for ring mechanisms may be quicker and more efficient than other known methods such as, for example, casting components from a mold and then subsequently assembling them. However, travel bars may be made using multiple steps within the scope of the present invention.

Figure 7:
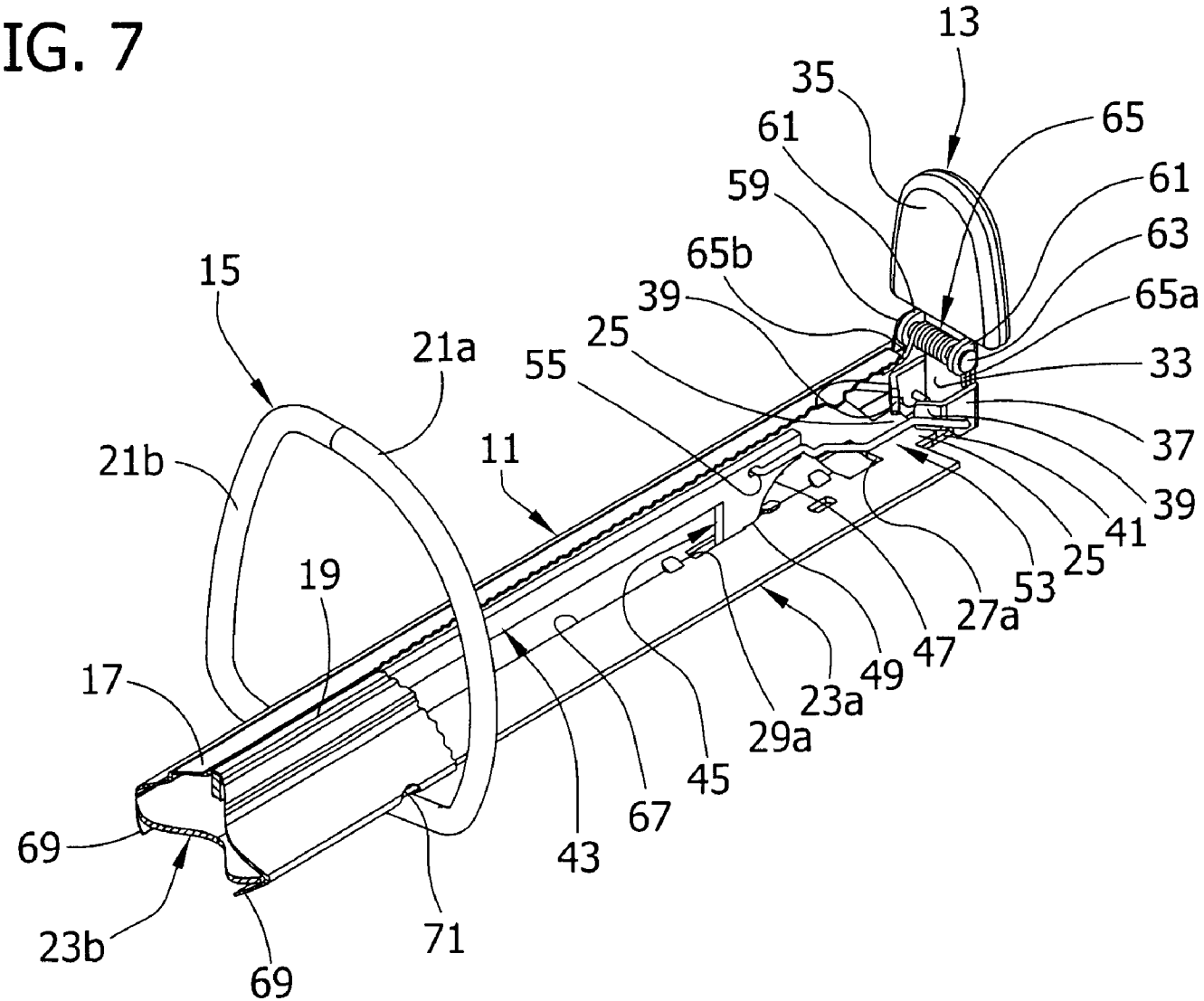
FIG. 7 is an enlarged and fragmentary top side perspective of a rearward end of the ring mechanism of FIG. 2 with part of a housing broken away and ring members removed to show internal construction.
Figure 8:
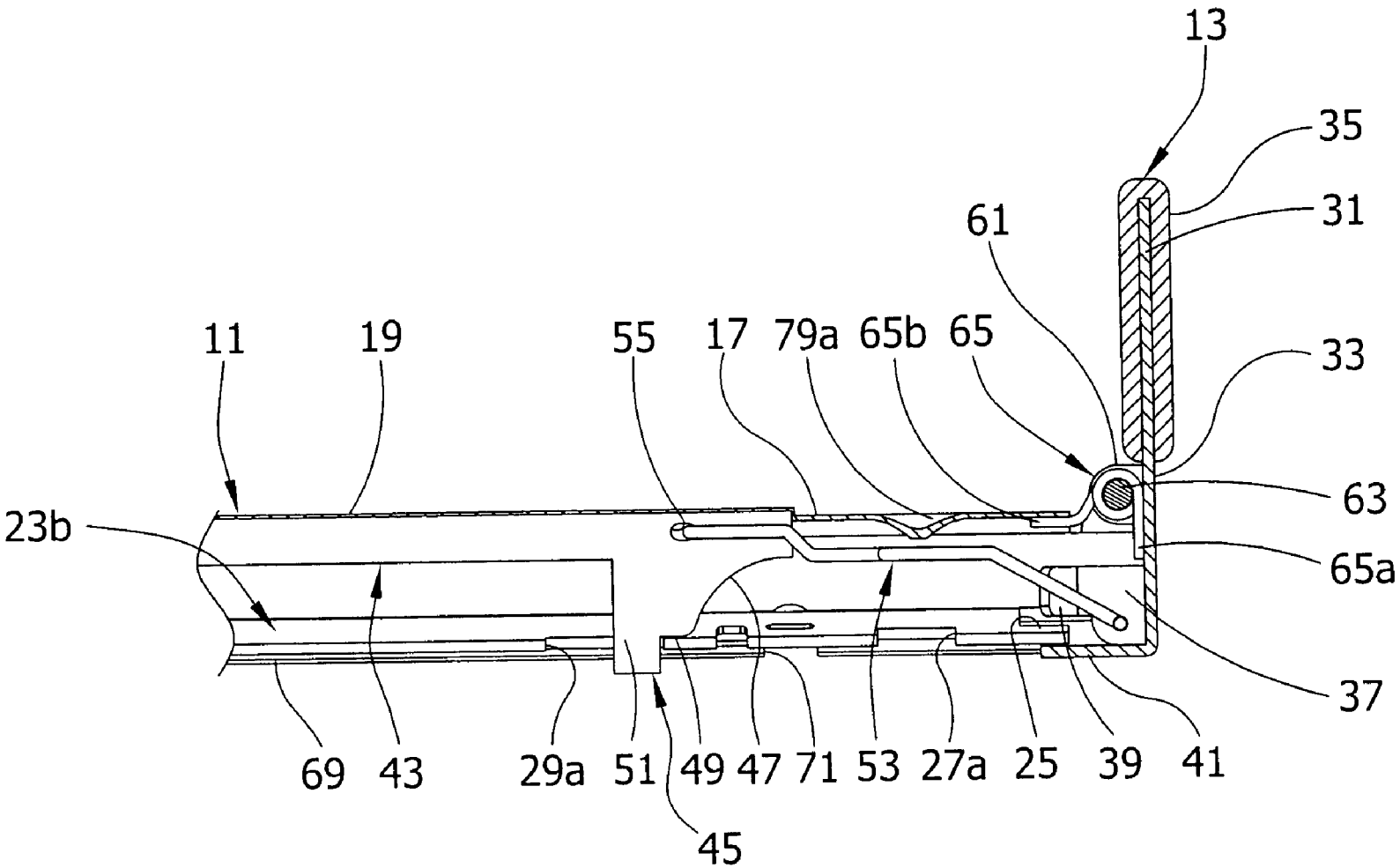
FIG. 8 is an enlarged and fragmentary side view of a rearward portion thereof with a lever shown in section and a hinge plate removed.

The assembled ring mechanism 1 will now be described with reference to FIGS. 7-9, which illustrate the ring members 21*a*, 21*b* of each ring 15 in the closed position. As shown in FIGS. 7 and 8, the lever 13 connects to the travel bar 43 by an intermediate connector, indicated generally at 53. The intermediate connector 53 is formed from a wire bent into an elongate, generally rectangular form having a rearward open end and a forward closed end (FIG. 5). The closed end is narrower than the open end and angles slightly upward from the open end. The open end connects to the travel bar 43 by looping through a rearward opening 55 of the travel bar and threading through the opening until the closed end is positioned in the opening. The open end then connects to the lever 13 at openings 57 in a respective one of the two closing arms 37 of the lever.

Figure 9:
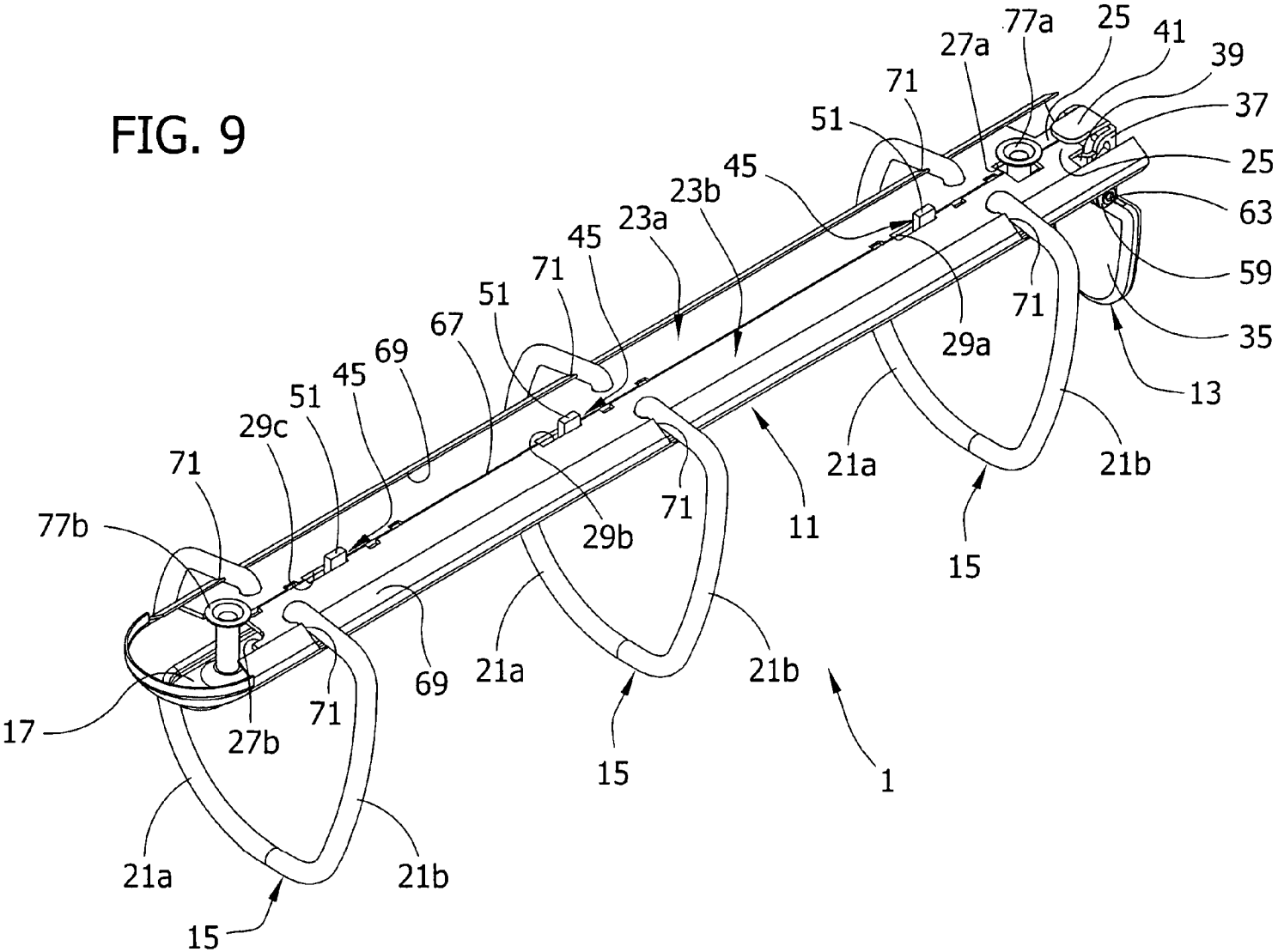
FIG. 9 is a bottom side perspective of the ring mechanism of FIG. 2.
Figure 10:
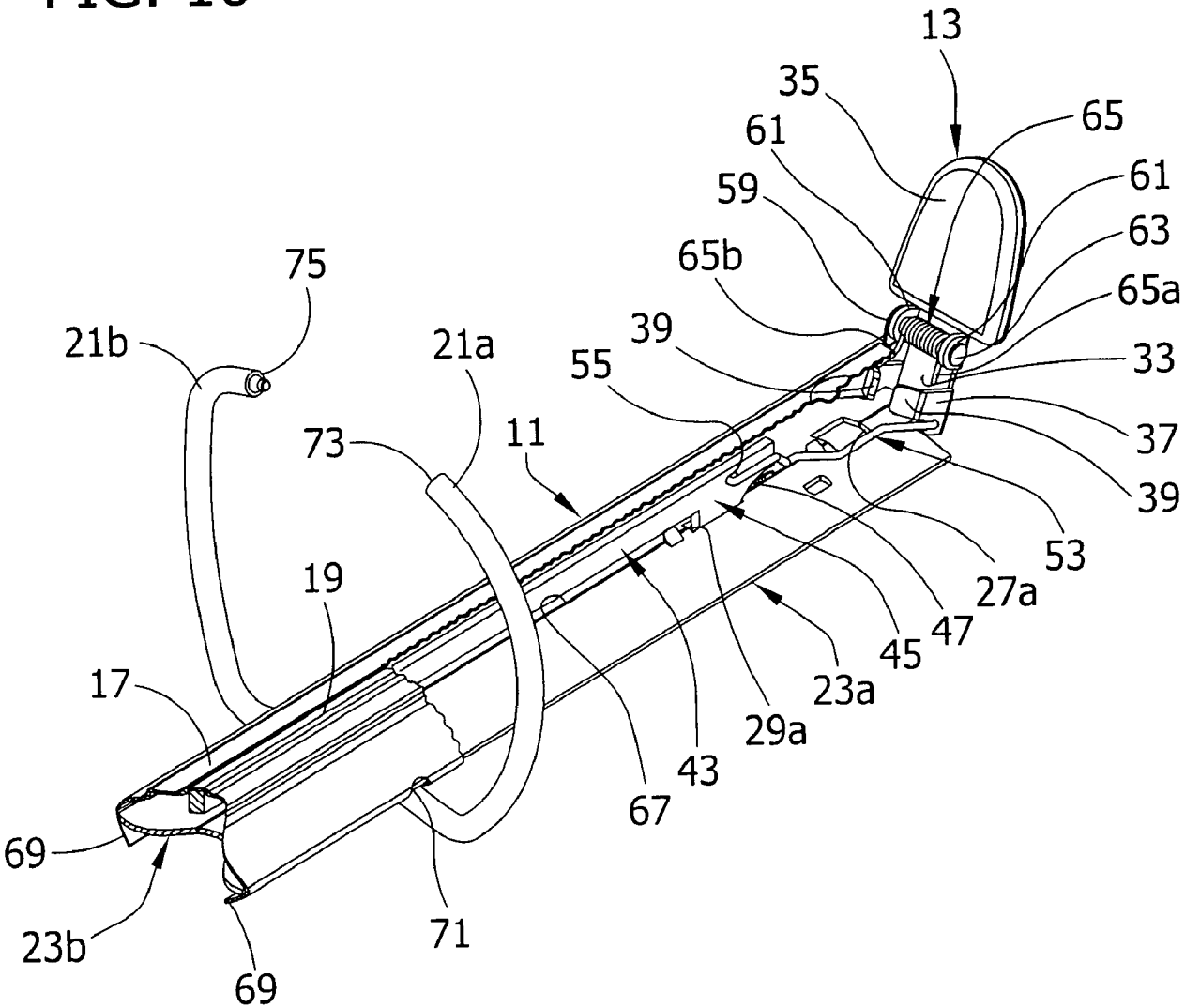
FIG. 10 is an enlarged and fragmentary top side perspective similar to FIG. 7 with the ring members in the open position.
Figure 11:
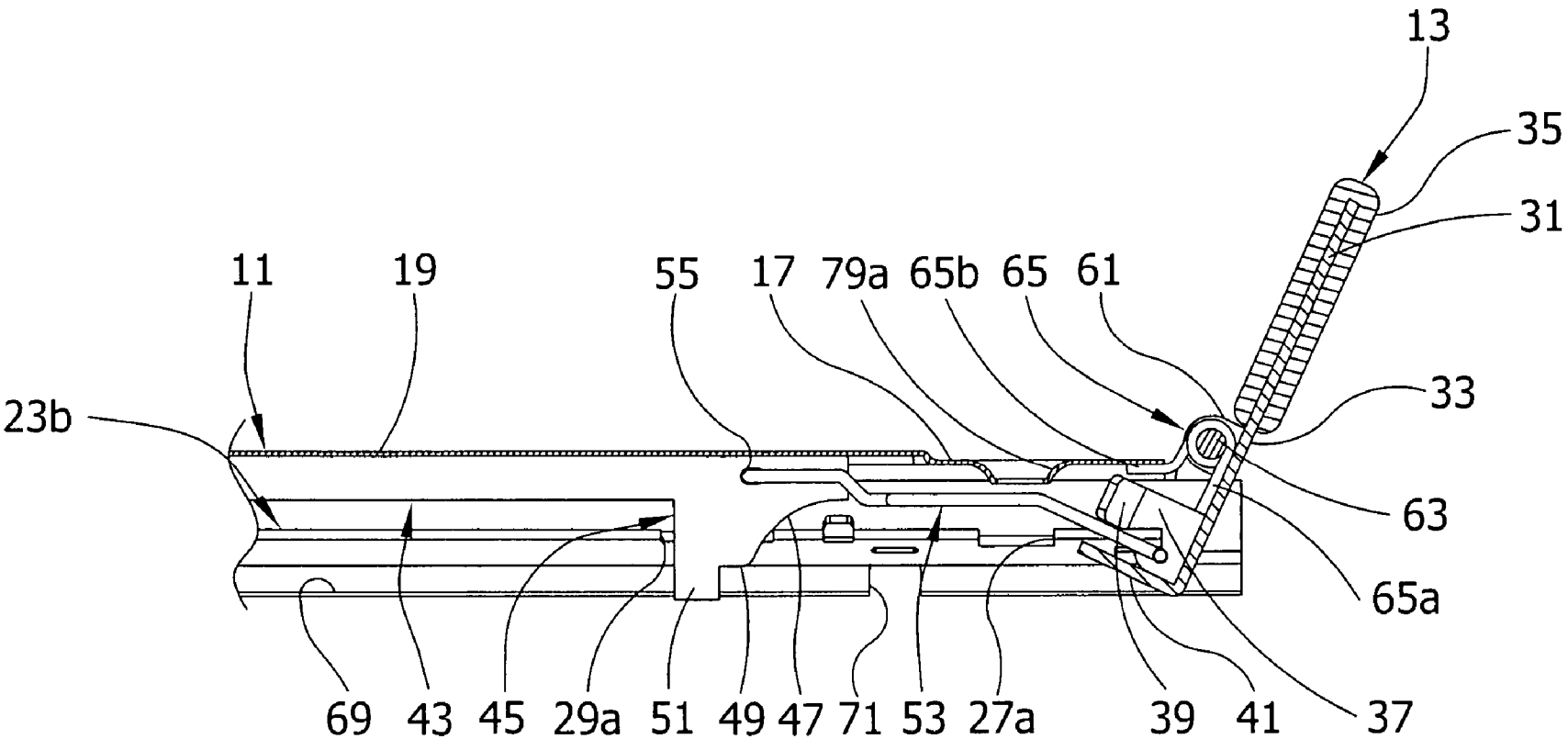
FIG. 11 is an enlarged and fragmentary side view similar to FIG. 8 with the ring mechanism in the open position and with ring members removed.
Figure 12:
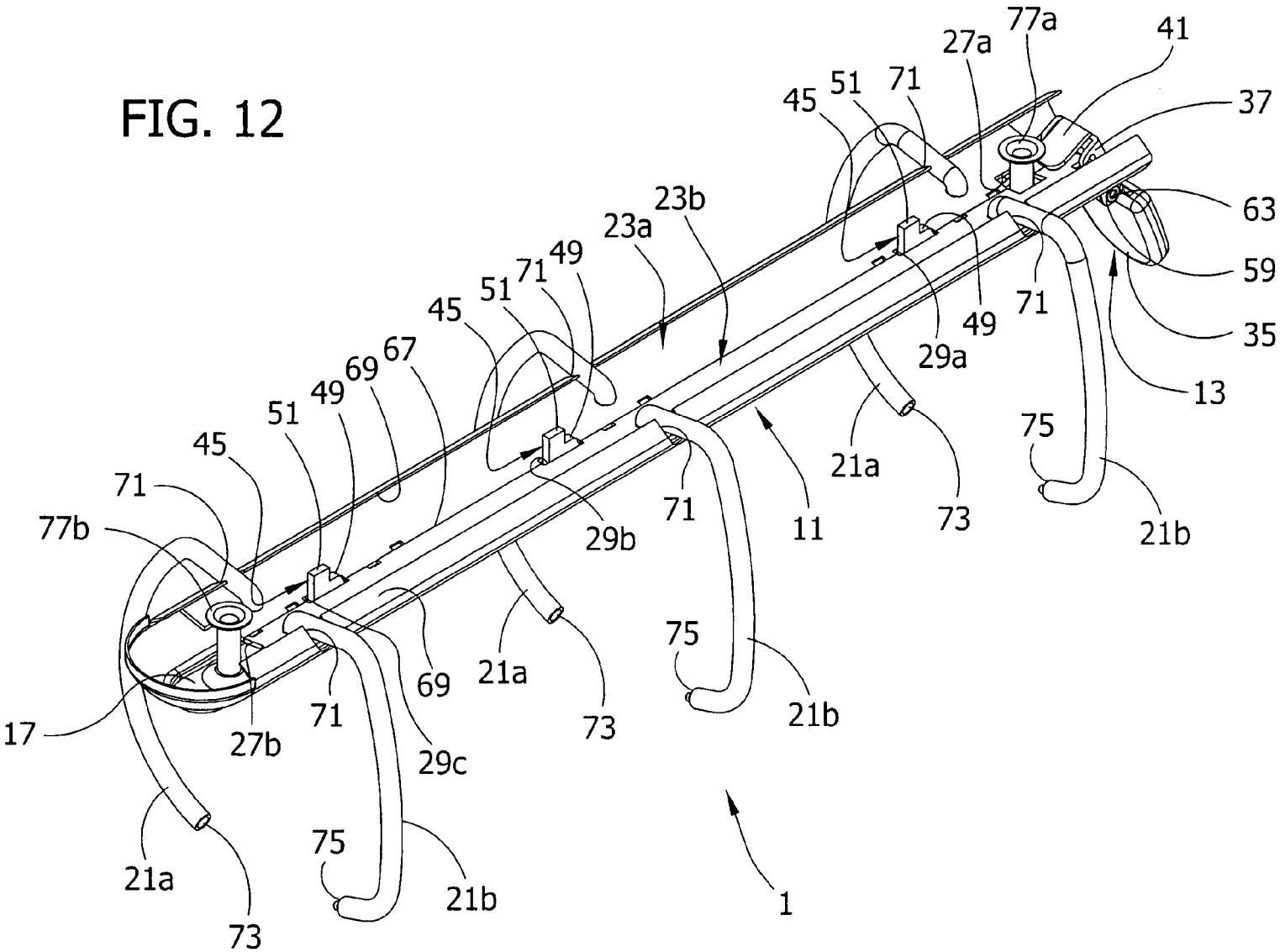
FIG. 12 is a bottom side perspective of the ring mechanism with the ring members in the open position.

As can be seen in FIGS. 7 and 9, the linked lever 13 and travel bar 43 mount on the housing 11 via the lever at the housing's rearward longitudinal end at mounting tabs 59 on opposite sides of the housing (only one mounting tab is visible, FIG. 5 illustrates both tabs). Corresponding mounting tabs 61 (FIG. 5) project forward from the body 33 of the lever 13, and openings in the lever mounting tabs 61 align with openings in the housing mounting tabs 59 for receiving a hinge pin 63 therethrough to pivotally mount the lever 13 on the housing 11. A torsion spring, indicated generally at 65, fits substantially between the lever mounting tabs 61 with the hinge pin 63 passing through the spring 65 and secure it to the lever 13. A first arm 65*a* of the spring 65 engages the body 33 of the lever 13, and a second arm 65*b* of the spring engages an underside of the housing plateau 17 (see FIG. 8). As will be descried in greater detail with respect to operation of the ring mechanism 1, the spring 65 is positioned to urge the lever 13 to pivot to an upright position and to resist movement of the lever outward and downward.

As shown in FIGS. 7 and 8, the travel bar 43 extends forward from the lever 13 in an upright position longitudinally of the housing 11. The travel bar 43 is oriented so that a generally vertical plane including a longitudinal axis of the housing 11 is generally parallel to a major surface of the travel bar. Broadly, travel bar 43 is oriented generally in a plane parallel to or coincident with a plane intersecting the central top portion and open bottom of the housing. The travel bar 43 aligns with the longitudinal channel 19 in the raised plateau 17 of the housing 11 and fits generally within the channel. The channel 19 is longer than the travel bar 43 and accommodates longitudinal movement of the travel bar (the travel bar is shown at a rearward end of the channel in FIG. 8 and at a forward end in FIG. 11). The channel 19 guides the travel bar movement during operation, loosely holds the travel bar 43 against lateral movement relative to the housing 11, and supports the travel bar in the upright position.

As shown in FIGS. 7-9, the first and second hinge plates 23*a*, 23*b* join together in parallel arrangement under the travel bar 43. The plane containing the travel bar 43 is oriented generally perpendicular to the hinge plates 23*a*, 23*b* when they are in a co-planar position (180°). The inner longitudinal edge margins of the hinge plates 23*a*, 23*b* engage and form a central pivoting hinge 67. The outer longitudinal edge margins of the hinge plates 23*a*, 23*b* loosely fit behind bent under rims 69 of the housing 11. It is understood that mounting of the hinge plates 23*a*, 23*b* on the housing 11 is essentially standard. The fingers 25 of the mounted hinge plates 23*a*, 23*b* extend rearward of the housing 11 and fit between the narrowed ends 39 of the closing arms 37 of the lever 13 and the flat opening arm 41 of the lever. Other mounting arrangements may be used within the scope of the present invention.

Respective mounting post cutouts 27*a*, 27*b* and locking element cutouts 29*a-c* in each hinge plate 23*a*, 23*b* align to form corresponding mounting post openings 27*a*, 27*b* and locking element openings 29*a-c* with the hinge 67 extending through each opening. The locking element openings 29*a-c* align with the locking elements 45 of the travel bar 43. When the ring mechanism 1 is closed, the flat shoulder 49 of each locking element 45 rests above the hinge 67 of the hinge plates 23*a*, 23*b* in engagement with upper surfaces of the hinge plates, and the lower arm 51 of each locking element 45 protrudes through the respective locking element opening 29*a-c* to a position below the hinge plates.

The ring members 21*a*, 21*b* extend away from the hinge plates 23*a*, 23*b* through ring openings 71 along lower longitudinal edges of the housing 11. The free ends 73, 75 of respective ring members 21*a*, 21*b* engage generally above the raised plateau 17 and securely hold the ring members in alignment.

Figure 2:
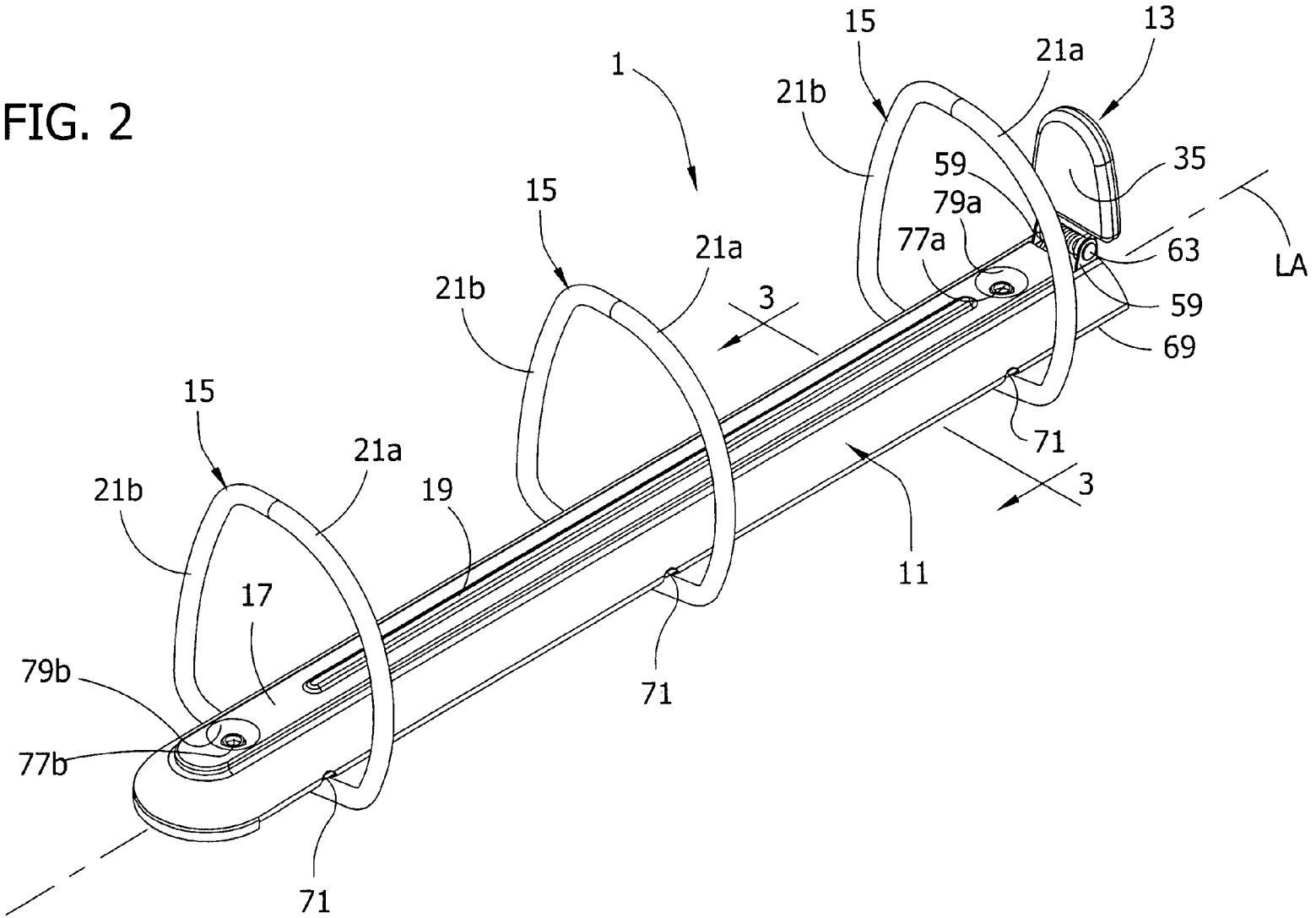
FIG. 2 is a top side perspective of the ring mechanism with ring members in a closed and locked position.
Figure 3:
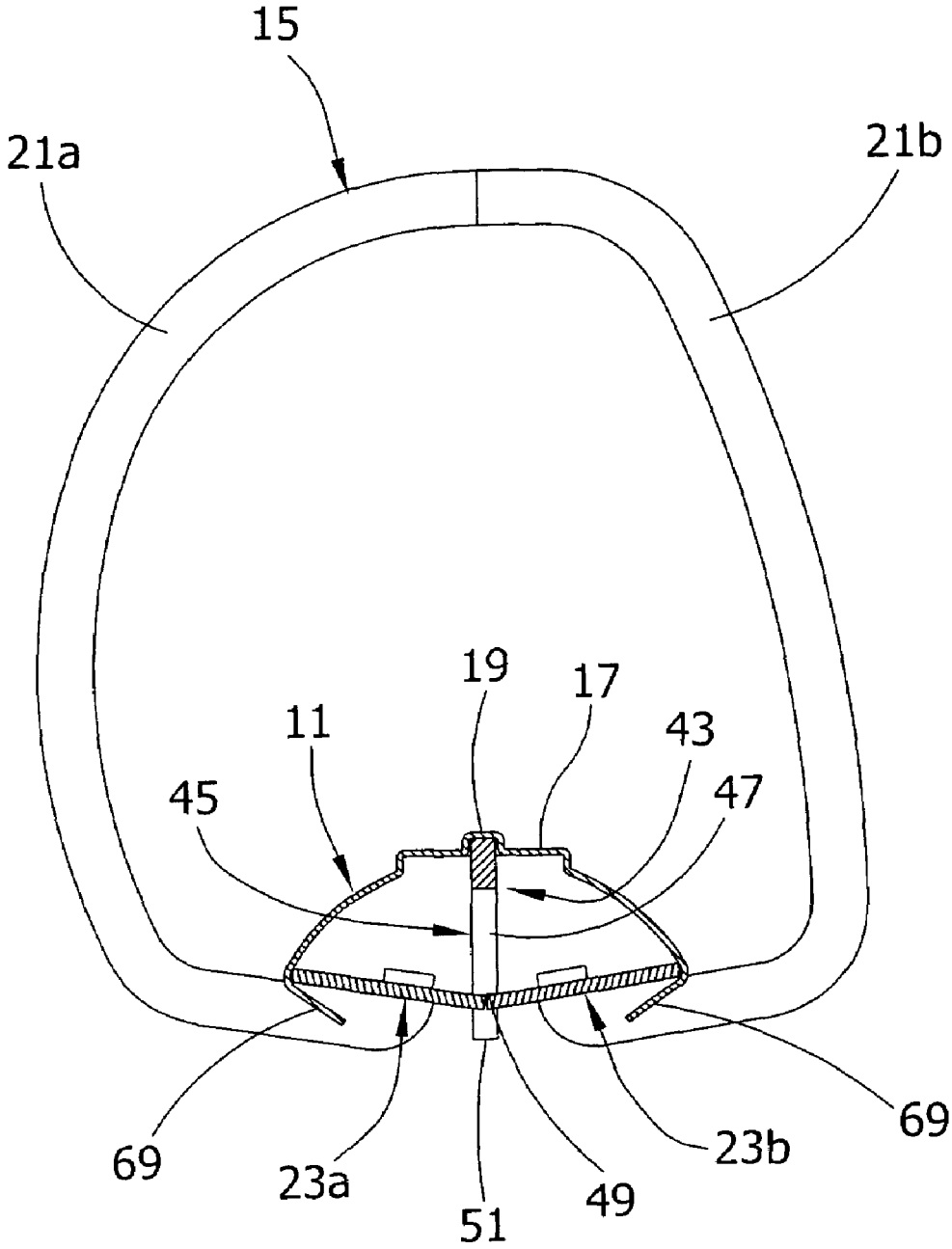
FIG. 3 is a cross section taken in the plane of line 3-3 of FIG. 2.

As shown in FIGS. 2 and 9, two mounting posts 77*a*, 77*b* connect to the housing 11 for mounting the ring mechanism 1 on a notebook (e.g., FIG. 1). A first mounting post 77*a* connects at a first mounting post opening 79*a* and extends downward through the intermediate connector 53 (not visible in FIGS. 2 and 9, but shown in FIG. 7) and through the first mounting post opening 27*a* of the hinge plates 23*a*, 23*b*. A second mounting post 77*b* similarly connects to the housing 11 at a second mounting post opening 79*b* and extends downward through the hinge plates 23*a*, 23*b* at a second hinge plate mounting post opening 27*b*. The mounting post openings 27*a*, 27*b* allow the hinge plates 23*a*, 23*b* to pivot about the hinge 67 relative to the mounting posts 77*a*, 77*b* without contacting them. In addition, the shape of the intermediate connector 53 allows it to move relative to the first mounting post 77*a* without contacting it, transmitting pivoting movement of the lever 13 around the mounting post 77*a* to the travel bar 43. A ring mechanism without an intermediate connector, for example one in which a travel bar is pivotally connected directly to a lever, or a mechanism with an intermediate connector shaped differently does not depart from the scope of this invention.

As is known regarding operation of ring mechanisms, the hinge plates 23*a*, 23*b* of the illustrated mechanism 1 pivot relative to the housing 11 about the hinge 67 downward and upward as the outer edge margins of the hinge plates move within the bent under rims 69 of the housing. The ring members 21*a*, 21*b* mounted on the hinge plates 23*a*, 23*b* move with the pivoting movement of the hinge plates together and apart. The housing 11, which is narrower than the hinge plates 23*a*, 23*b* when the plates are in the co-planar position, provides a small spring force that biases the hinge plates to pivot fully downward or fully upward. But the spring force of the housing 11 of this ring mechanism 1 is generally smaller than that of traditional mechanisms. When the hinge plates 23*a*, 23*b* pivot downward, the ring members 21*a*, 21*b* close; when the hinge plates 23*a*, 23*b* pivot upward, the ring members 21*a*, 21*b* open.

FIGS. 1-3 and 7-9 illustrate the ring mechanism 1 with the ring members 21*a*, 21*b* in the closed position, and FIGS. 4, 10-12 illustrate the mechanism 1 with the ring members 21*a*, 21*b* in the open position. In the closed position of the ring members 21*a*, 21*b*, the hinge plates 23*a*, 23*b* are hinged downward, away from the housing 11, so that the first and second ring members 21*a*, 21*b* of each ring 15 are together. The lever 13 is generally vertical and the torsion spring 65 adjacent the lever is minimally tensioned, but still resisting movement of the lever 13 outward and downward. The travel bar 43 is in a locked position toward the lever 13. The locking elements 45 are each located with its flat shoulder 49 behind the hinge plates 23*a*, 23*b*, blocking upward movement, and with its lower arm 51 through the respective locking element opening 29*a-c*. The hinge plates 23*a*, 23*b* support the locking elements 45 and travel bar 43 above the plates. Any upward movement of the hinge plates 23*a*, 23*b* causes the hinge plates to bear against the flat shoulder 49 of each locking element 45 and push upward on the travel bar 43 within the housing channel 19. But the travel bar 43 does not move upward because it is already in contact with the housing 11. The hinge plates 23*a*, 23*b* have nowhere to pivot around the locking elements 45 and travel bar 43 and are held in their downward pivoted position. Thus, the ring members 21*a*, 21*b* are locked closed.

To unlock the ring mechanism 1 and open the ring members 21*a*, 21*b*, the lever 13 is pivoted outward and downward against the tension of the torsion spring 65 (i.e., against the resistance of the first spring arm 65*a* to move toward the second spring arm 65*b*). The opening arm 41 of the lever 13 moves upward, against the fingers 25 of the hinge plates 23*a*, 23*b*, and pushes the intermediate connector 53 forward. The intermediate connector 53 pushes the travel bar 43 forward, sliding it within the longitudinal channel 19.

The intermediate connector 53 creates a dynamic connection between the lever 13 and travel bar 43. The connection at the lever 13 is pivotal in nature so that the intermediate connector 53 can freely pivot with respect to the lever 13 while moving conjointly with the lever in translation along the longitudinal axis LA (FIGS. 2 and 4) of the housing 11. Similarly, the intermediate connector 53 may pivot freely with respect to the travel bar 43 while moving the travel bar conjointly with the intermediate connector 53 in translation along the longitudinal axis LA of the ring mechanism 1. Thus, pivoting the lever 13 either pushes the travel bar 43 away from the lever or pulls it toward the lever. However, this connection is still loose enough to allow the intermediate connector 53 to pivot relative to the travel bar 43 to accommodate small amounts of pivoting movement of the connector occurring when the lever 13 pivots and moves the connector 53.

The locking elements 45 move with the travel bar 43 so that the flat shoulder 49 of each locking element moves from behind the hinge plates 23*a*, 23*b* into registration over each respective locking element opening 29*a-c*. If the lever 13 is released, the spring 65 automatically urges the lever 13 to move back to its vertical position, pulling the travel bar 43 and locking elements 45 back to the locked position.

The lever opening arm 41 pushes the hinge plates 23*a*, 23*b* just through the co-planar position, and the housing spring force pivots the hinge plates 23*a*, 23*b* to their full upward position. The locking element openings 29*a-c* in the hinge plates 23*a*, 23*b* pass over the respective locking elements 45. Rearward edges of each opening 29*a-c* engage the arcuate rearward edge 47 of each respective locking element (FIG. 11), supporting the travel bar 43 above the hinge plates within the housing channel 19. It will be understood that a travel bar may be supported other than by hinge plates within the scope of the present invention. Moreover, a travel bar may be located below hinge plates of a ring mechanism. The ring members 21*a*, 21*b* open, and the lever 13 can be safely released. The torsion spring 65 recoils slightly and pivots the lever 13 slightly upward and inward, moving the lever's closing arms 37 into contact with upper surfaces of the hinge plates 23*a*, 23*b*. The travel bar 43 and locking elements 45 move only slightly because the arcuate rearward edge 47 of each locking element is already engaging the rearward edge of the respective locking element opening 29*a-c*. The housing spring force holds the hinge plates 23*a*, 23*b* upward and the ring members 21*a*, 21*b* open.

To close the ring members 21*a*, 21*b* and lock them together, either the lever 13 can be pivoted upward and inward or the ring members can be pushed together. Pivoting the lever 13 causes the lever closing arms 37 to push the hinge plates 23*a*, 23*b* downward while the lever 13 simultaneously pulls the travel bar 43 rearward. The shape of the arcuate rearward edge 47 of each locking element 45 causes the hinge plates 23*a*, 23*b* to slide down along the arcuate edges as the locking elements move, partly camming the hinge plates downward (in addition to the downward force provided by the closing arms 37). These combined downward forces push the hinge plates 23*a*, 23*b* to the co-planar position where the housing spring force biases them to their full downward position. The torsion spring 65 then pivots the lever 13 to its vertical position, which in turn pulls the travel bar 43 and locking elements 45 to the locked position.

The ring members 21*a*, 21*b* can also be closed by pushing the ring members together, which directly pivots the hinge plates 23*a*, 23*b* downward. The opening arm 41 of the lever 13 is moved down by the hinge plates 23*a*, 23*b* and the rearward edges of the hinge plate locking element openings 29*a-c* slide down the arcuate rearward edges 47 of the respective locking elements 45 (as the locking elements are incrementally moved by the spring-biased lever). When the hinge plates 23*a*, 23*b* reach the co-planar position, the housing spring force biases them to their full downward position. The torsion spring 65 simultaneously pivots the lever 13 to its full vertical position. The lever 13 pulls the travel bar 43 and locking elements 45 to the locked position (i.e., with the shoulders 49 engaging the upper surfaces of the hinge plates 23*a*, 23*b*).

In this ring mechanism 1, the opening arm 41 of the lever 13 is initially spaced slightly below the hinge plates 23*a*, 23*b* (FIG. 8). So when the lever 13 pivots to open the ring members 21*a*, 21*b*, the travel bar 43 and locking elements 45 move immediately and prior to the opening arm 41 engaging and pivoting the hinge plates 23*a*, 23*b*. In addition, after the opening arm 41 of the lever 13 engages the hinge plates 23*a*, 23*b*, the opening arm slides a short distance forward along the hinge plates before actually pivoting them upward. This lost motion action allows the locking elements 45 to move into registration over respective hinge plate cutout openings 29*a-c* before the hinge plates 23*a*, 23*b* pivot upward. Accordingly, the locking elements 45 do not impede the pivoting movement of the hinge plates 23*a*, 23*b* to open the ring members 21*a*, 21*b*. It is only after the flat shoulders 49 of the locking elements 45 register over the respective openings 29*a-c* that the opening arm 41 moves the hinge plates 23*a*, 23*b* upward.

It is understood that a ring mechanism with levers at both longitudinal ends of a housing is within the scope of the invention. It is also understood that actuators other than levers, for example, push buttons, could be used without changing the scope of the invention.

FIGS. 13-22 show a ring mechanism according to a second embodiment generally at 101. Parts of this mechanism corresponding to parts of the ring mechanism 1 of the first embodiment of FIGS. 1-12 are identified by the same reference numerals, plus "100." With the exception of the modifications described below, it is understood that the mechanism 101 of this embodiment is the same as the mechanism 1 of the first embodiment.

Figure 13:
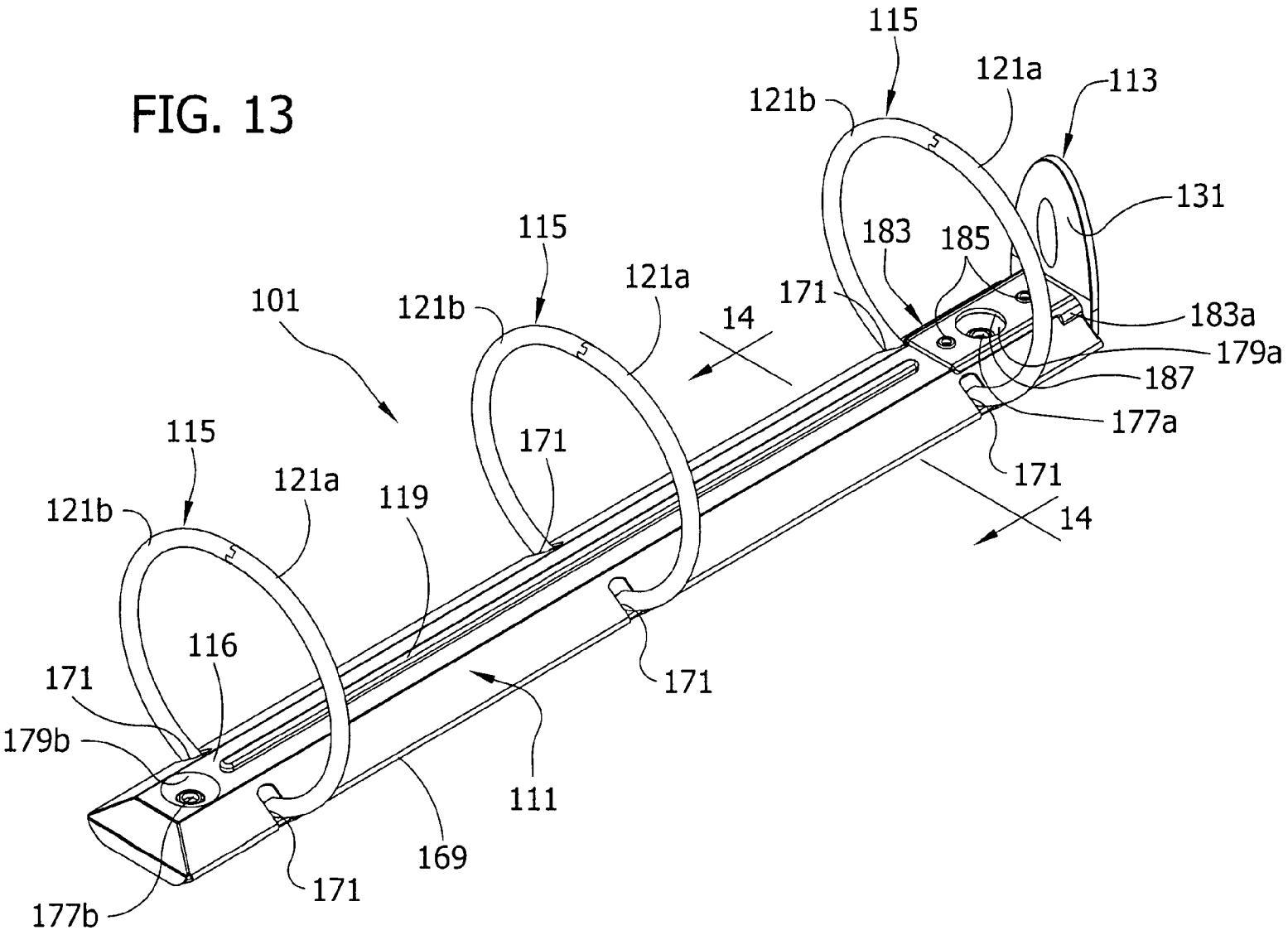
FIG. 13 is a top side perspective of a ring mechanism according to a second embodiment with ring members in the closed and locked position.
Figure 14:
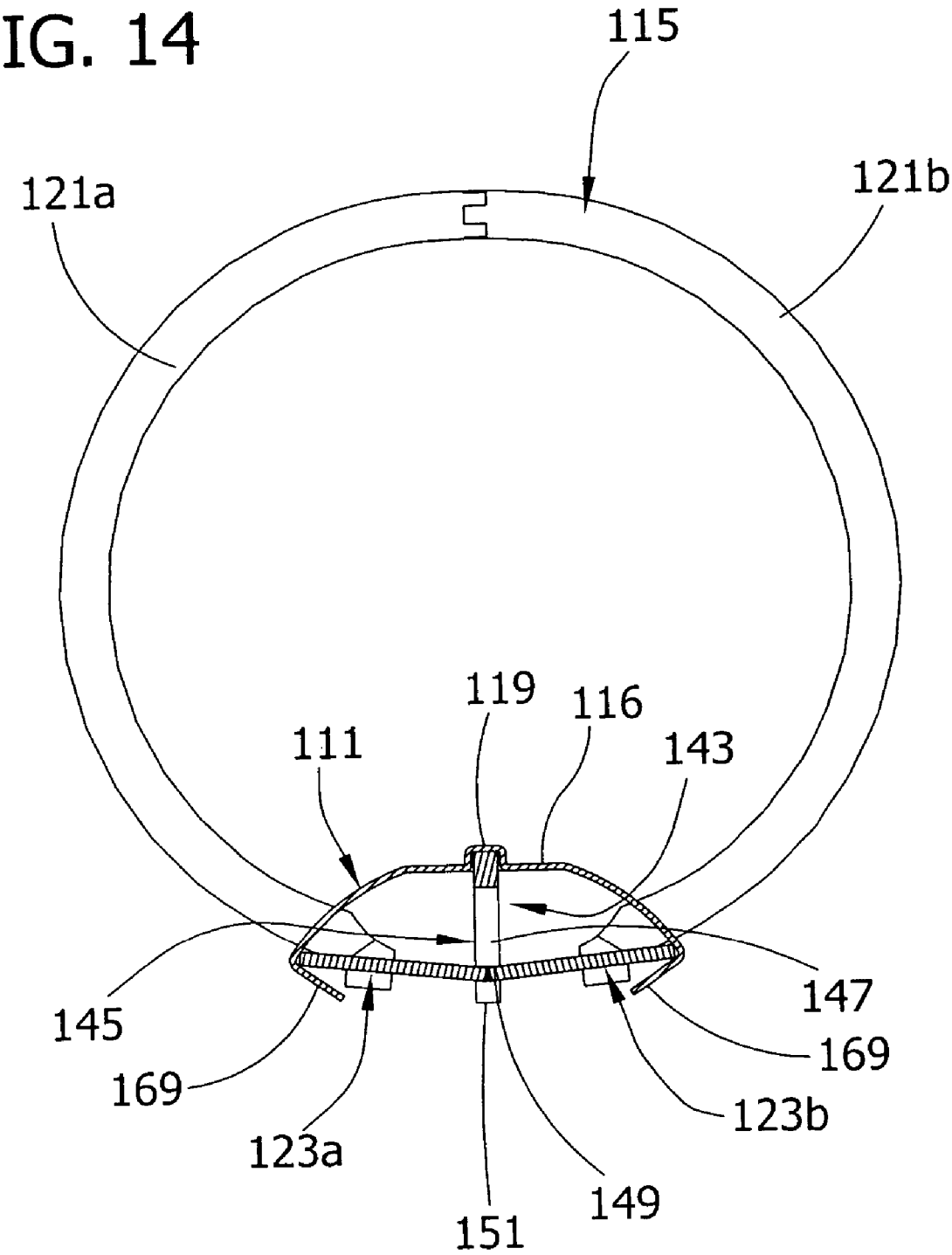
FIG. 14 is a cross section taken in the plane of line 14-14 of FIG. 13.

Referring to FIGS. 13-16, a housing 111, rings 115, and hinge plates 123*a*, 123*b* are modified in this embodiment. The housing 111 includes a relatively flat (not raised) plateau 116 along its upper surface. Rings 115 include first and second ring members 121*a*, 121*b* that, in the closed position, form a continuous closed circular-shaped loop (FIGS. 13 and 14). Free ends 174, 176 of the first and second ring members 121*a*, 121*b*, respectively, are each formed with mating structure comprising four fingers. The structure of the second ring member 121*b* is rotated 45° relative to the structure of the first ring member 121*a*. When the ring members 121*a*, 121*b* close, the mating structure securely holds the ring members together against lateral misalignment.

Figure 16:
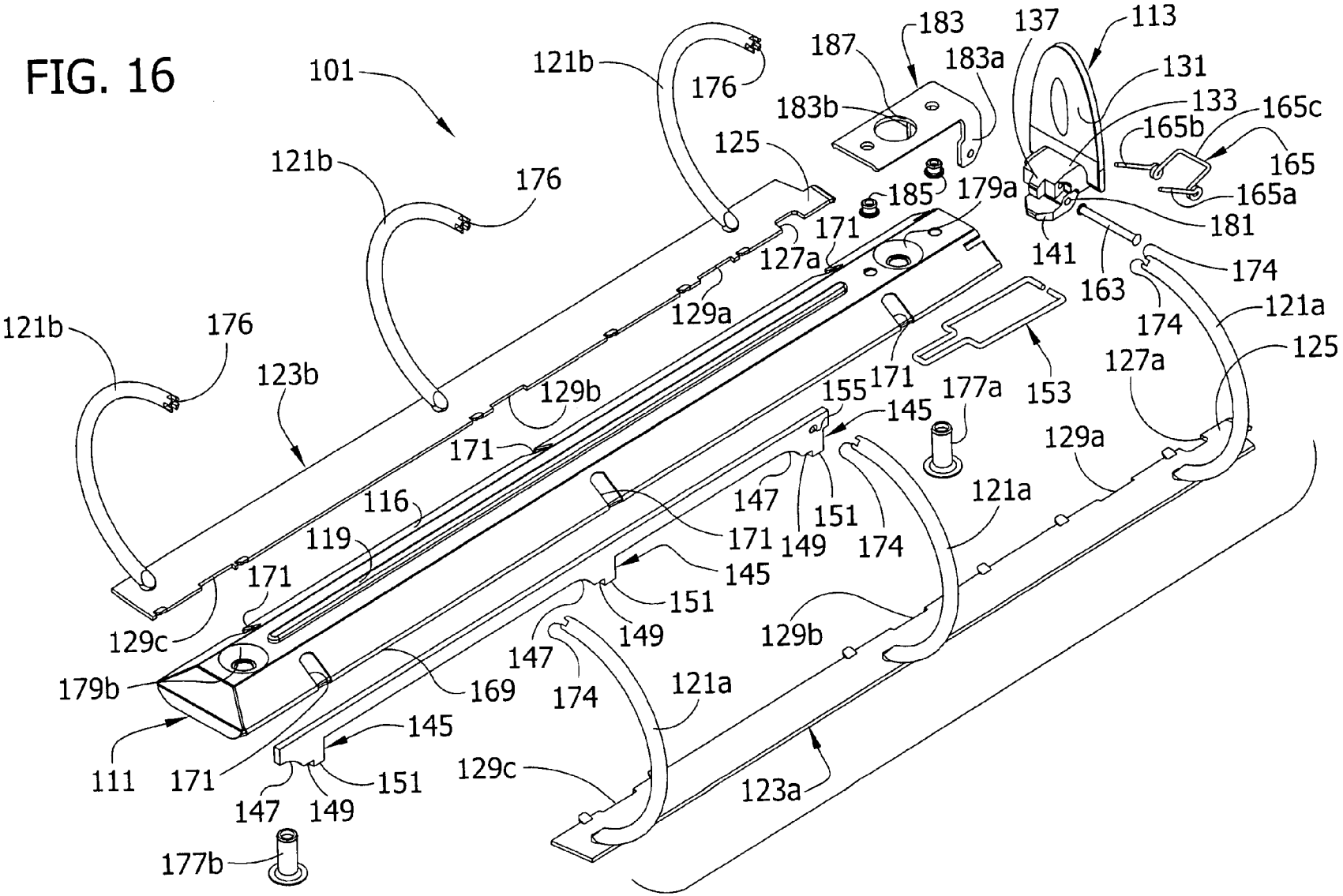
FIG. 16 is an exploded perspective of the ring mechanism.

Referring to FIG. 16, first and second hinge plates 123*a*, 123*b* of this embodiment do not each include a mounting post cutout at the forward end of the hinge plate. A second mounting post 177*b* at the forward end of the ring mechanism 101 passes by the ends of the hinge plates 123*a*, 123*b* without engaging them (e.g., FIGS. 19 and 22). Also in this embodiment, first and second ring members 121*a*, 121*b* of each ring 115 mount on upper surfaces of the respective first and second hinge plates 123*a*, 123*b*. They extend upward from the hinge plates 123*a*, 123*b* more directly than in the first embodiment and thus require enlarged ring openings 171 along longitudinal edge margins of the housing 111. The enlarged openings 171 provide additional room for the ring members 121*a*, 121*b* to move relative to the housing 111 without contacting it.

As shown in FIG. 16, the lever 113 is generally L-shaped with an enlarged, flat head 131 and a C-shaped base 133. The base 133 is connected to the head 131 toward the bottom of the head and includes a single upper closing arm 137 and a single spaced apart lower opening arm 141. The closing and opening arms 137, 141 extend away from the head 131 in generally perpendicular orientation to the head and in generally parallel relation to each other. In operation, the closing and opening arms 137, 141 receive fingers 125 of the hinge plates 123*a*, 123*b* therebetween as previously described for the lever 13 of the first embodiment to move the hinge plates 123*a*, 123*b* downward and upward.

Figure 17:
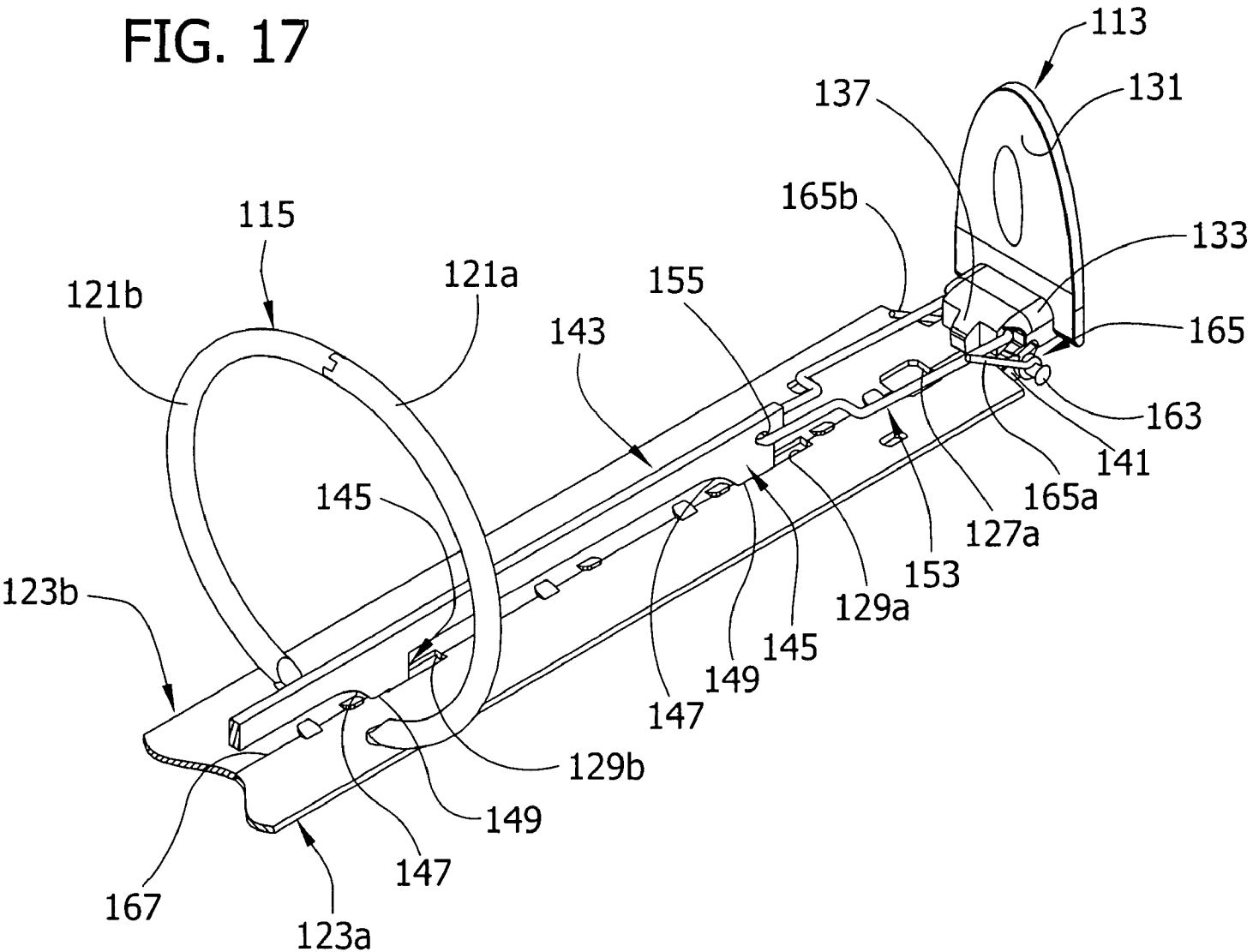
FIG. 17 is an enlarged and fragmentary top side perspective of the rearward end of the ring mechanism of FIG. 13 with a housing and ring members removed.
Figure 18:
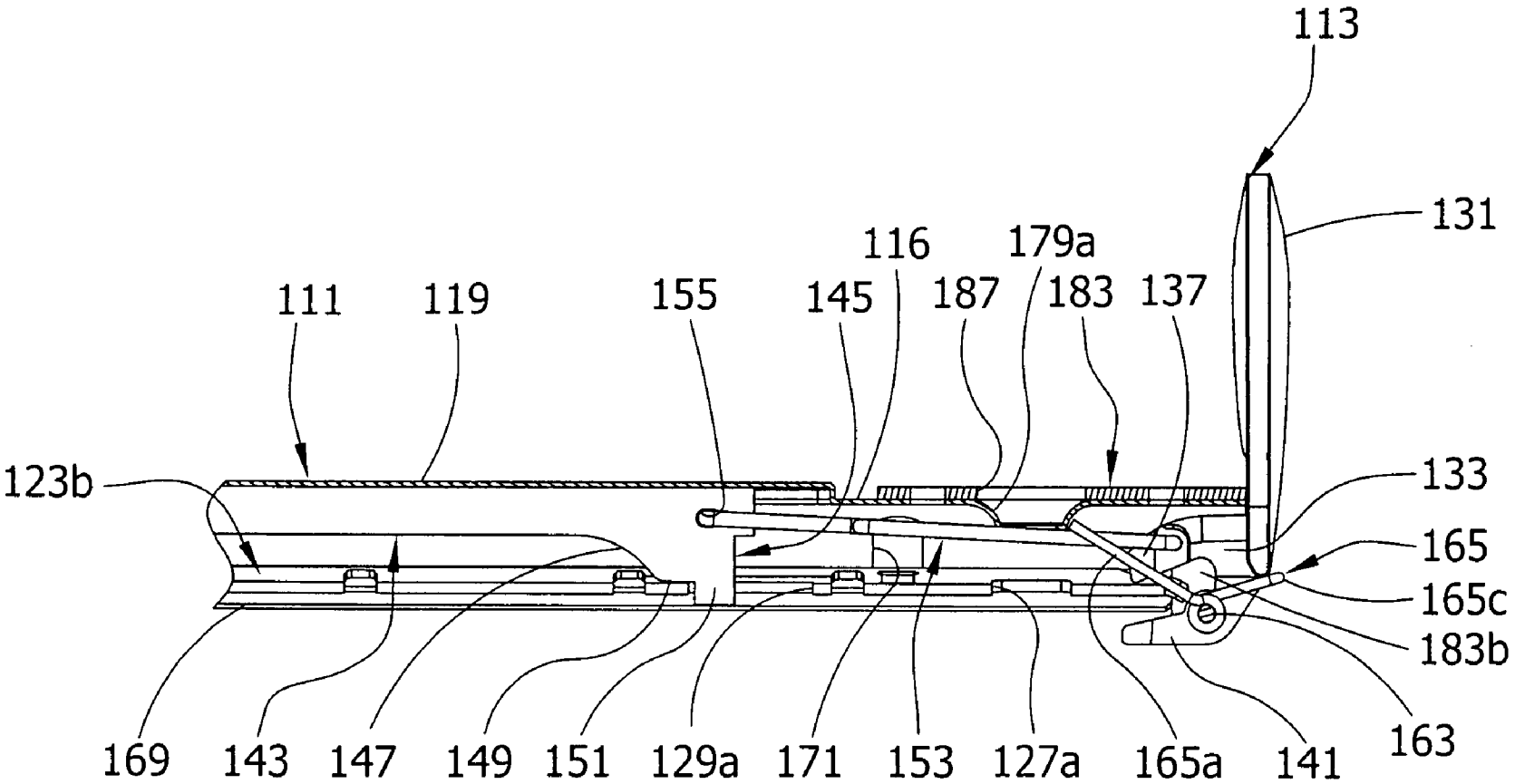
FIG. 18 is an enlarged and fragmentary side view of the ring mechanism of FIG. 13 with part of the housing broken away and parts of the mechanism removed.
Figure 19:
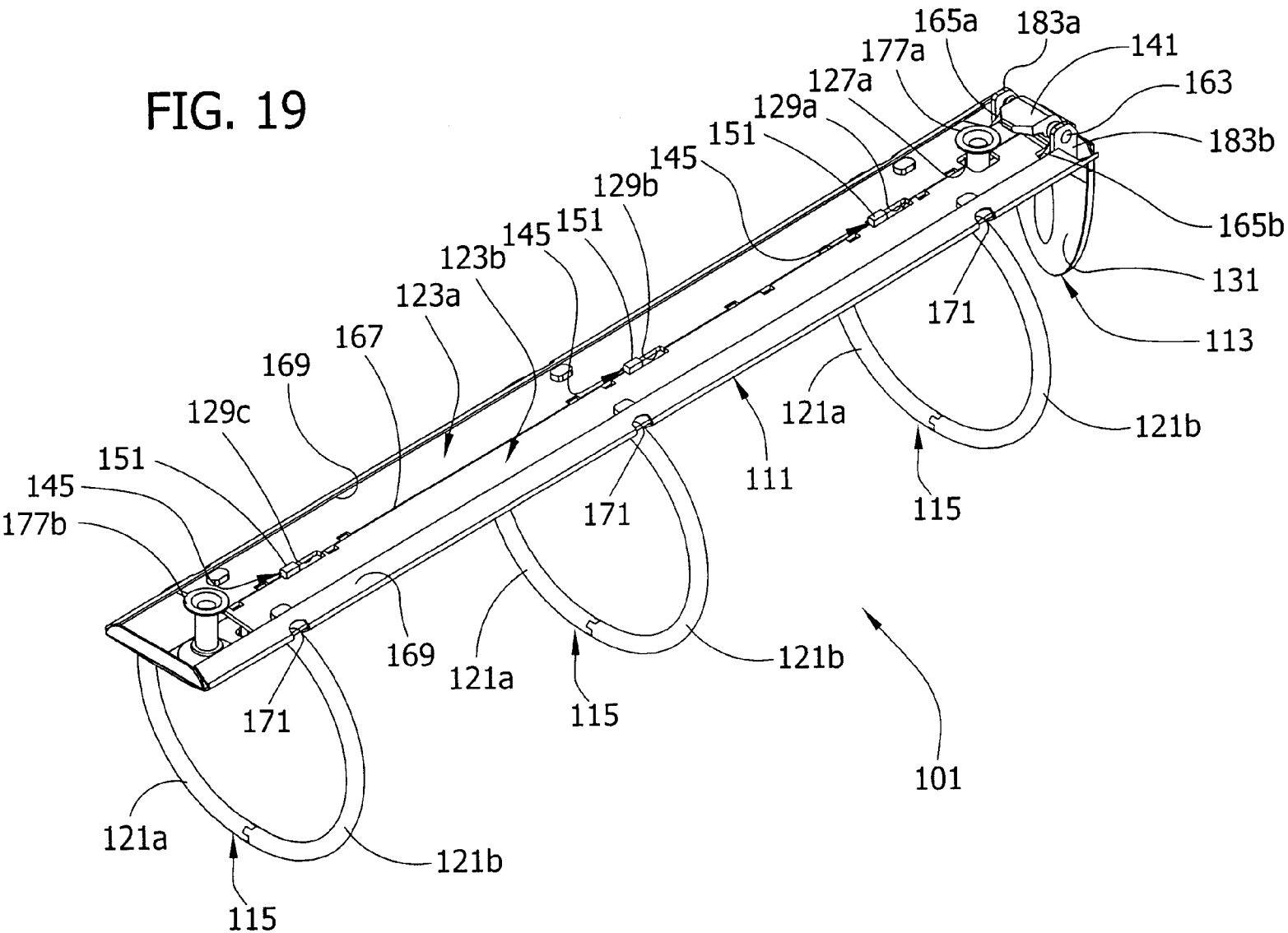
FIG. 19 is a bottom side perspective of the ring mechanism of FIG. 13.
Figure 20:
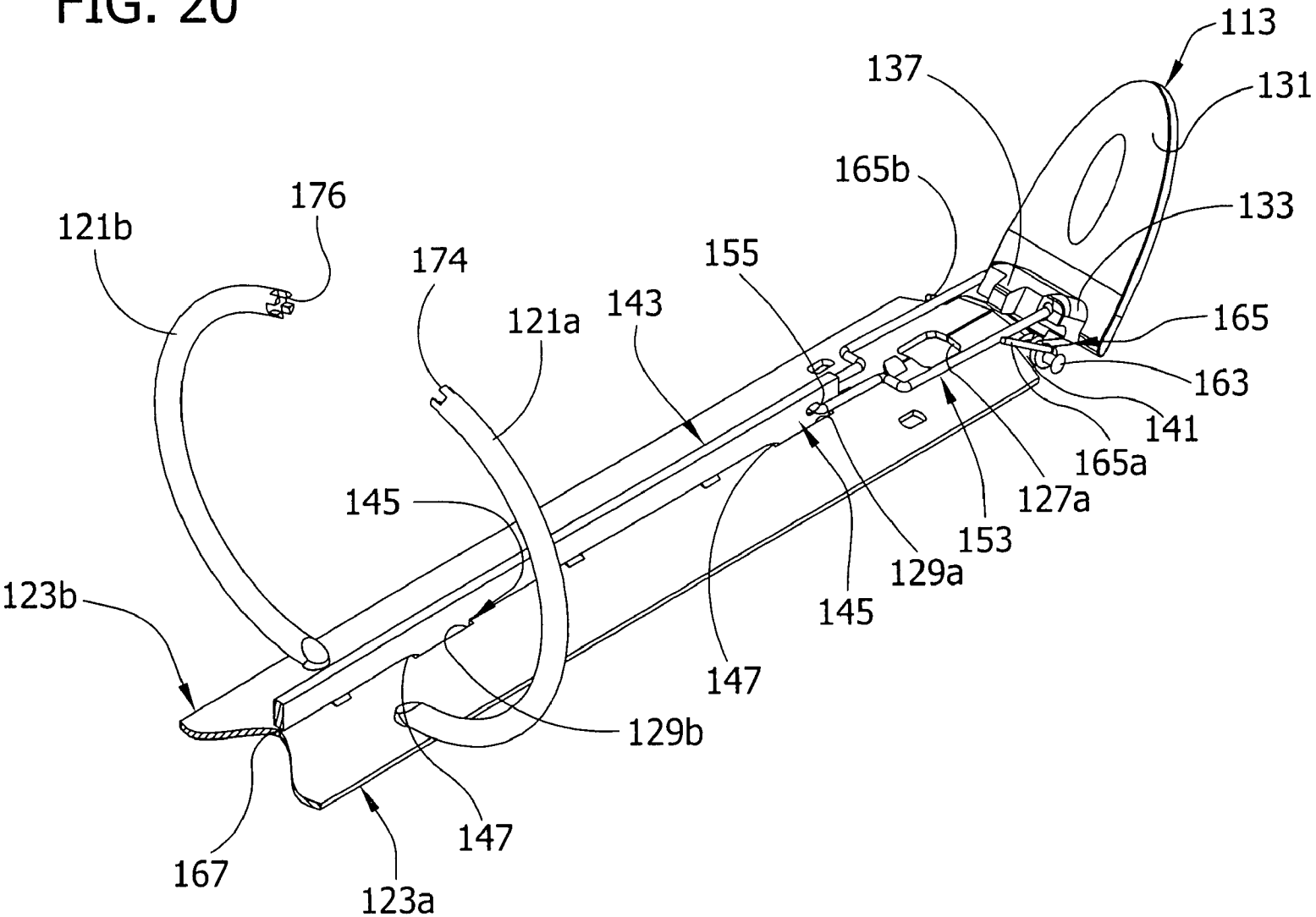
FIG. 20 is an enlarged and fragmentary top side perspective similar to FIG. 17 with the ring members in the open position.
Figure 21:
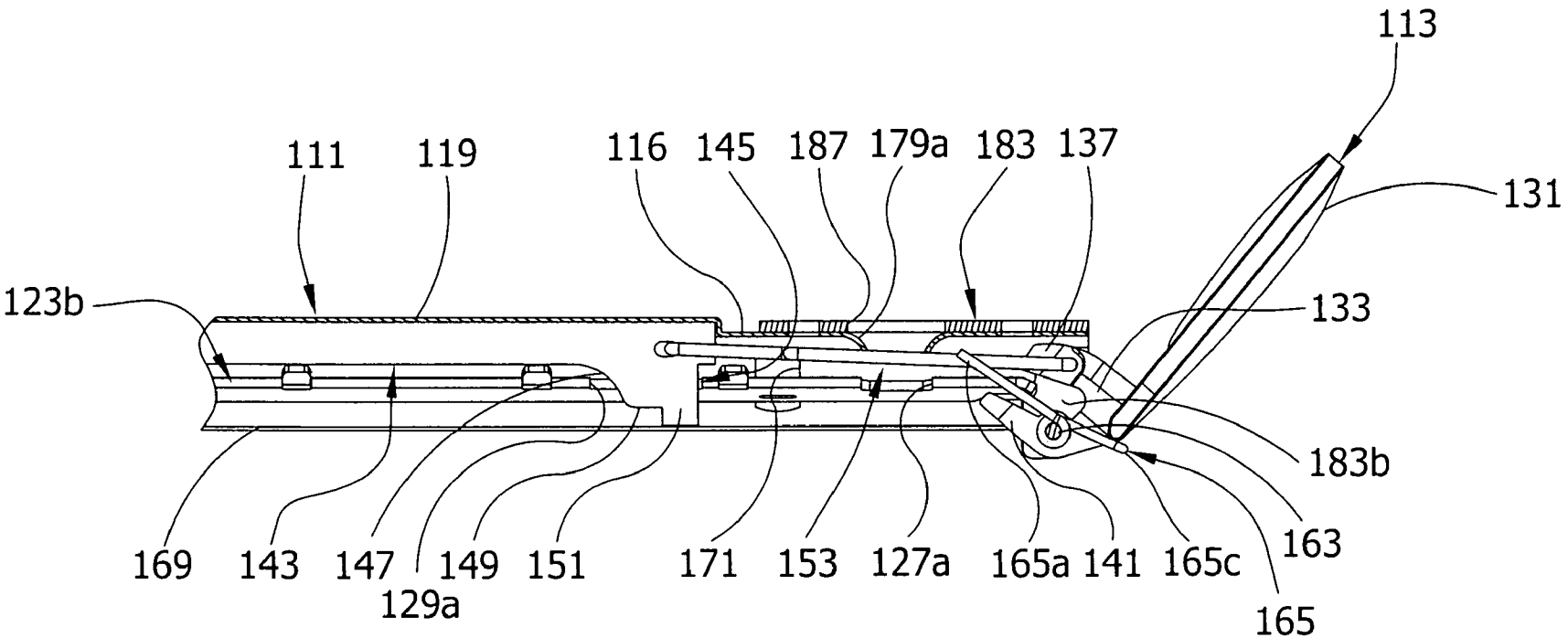
FIG. 21 is an enlarged and fragmentary side view similar to FIG. 18 with the ring mechanism in the open position and ring members removed.
Figure 22:
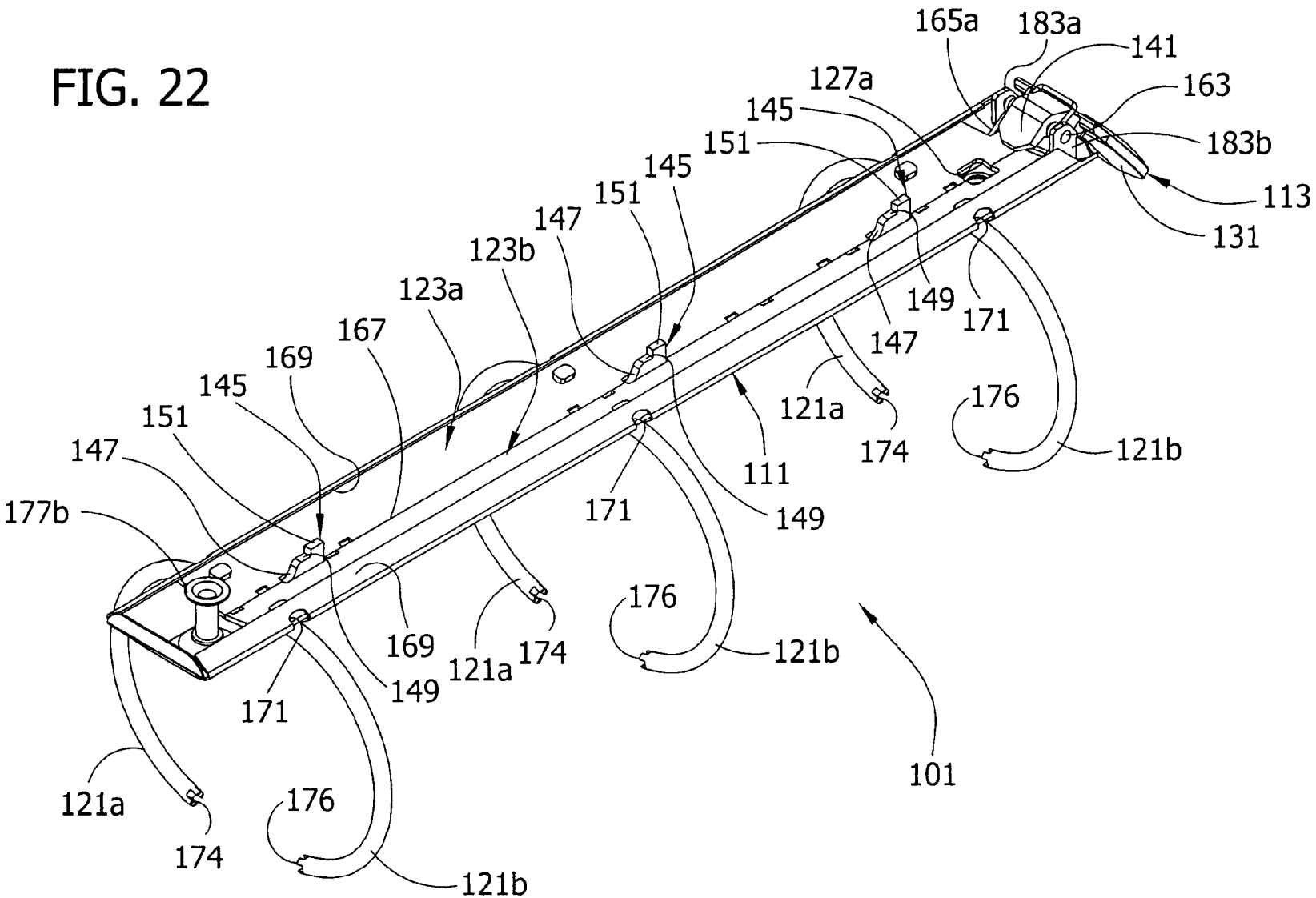
FIG. 22 is a bottom side perspective of the ring mechanism of FIG. 15.
Figure 23:
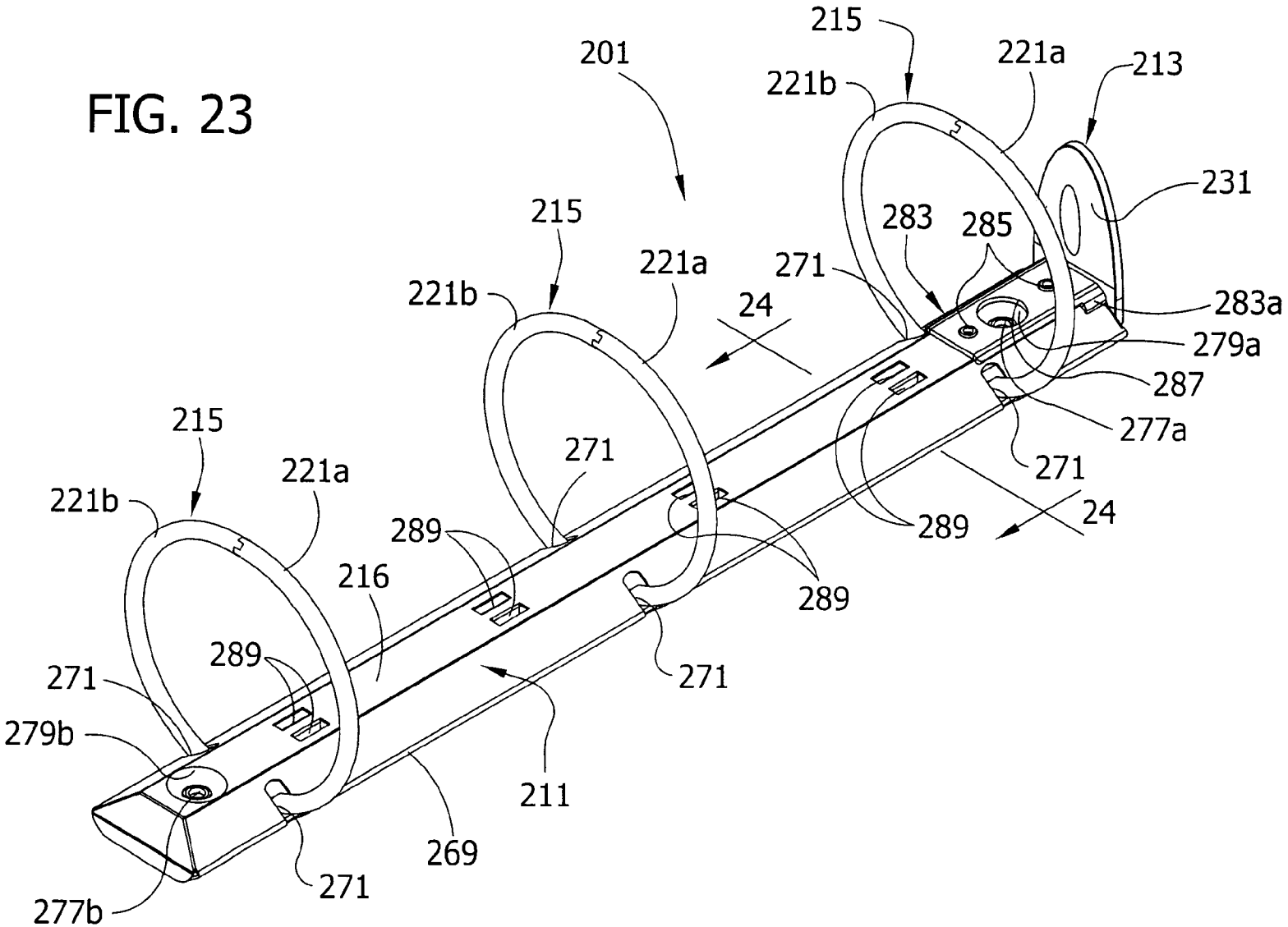
FIG. 23 is a top side perspective of a ring mechanism according to a third embodiment with ring members in the closed and locked position.

As also shown in FIG. 16, a biasing spring 165 is illustrated as a torsion spring that includes a closed end 165*c* and two side arms 165*a*, 165*b* bent upward at an angle of about 45° from the closed end. A loop is formed in each side arm 165*a*, 165*b* adjacent where the arm bends upward for connecting the torsion spring 165 to the lever 113 (FIGS. 17-19). The closed end 165*c* of the torsion spring 165 extends around the base 133 of the lever 113 about where the base extends from the head 131. The loop of each side arm 165*a*, 165*b* of the torsion spring 165 aligns on opposite sides of the opening arm 141 of the lever 113 with an aperture 181 through the opening arm.

Figure 15:
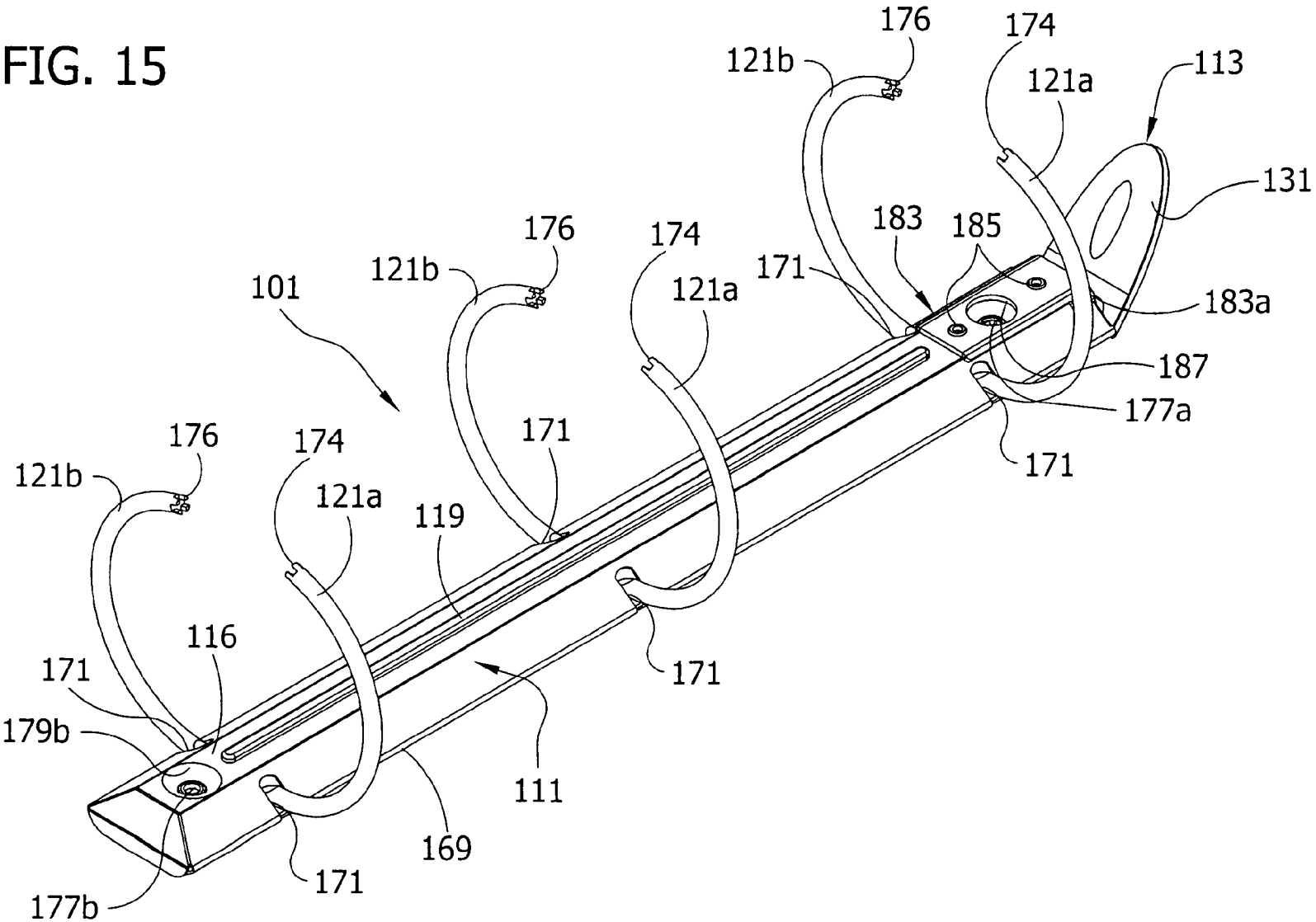
FIG. 15 is a top side perspective of the ring mechanism with ring members in the open position.

The lever 113, along with the torsion spring 165, attaches to a lever mount indicated generally at 183 that is separate from the housing 111. Two arms 183*a*, 183*b* project downward from the lever mount 183 (FIG. 16) and align with the loops of each side arm 165*a*, 165*b* of the torsion spring 165 and with the aperture 181 through the opening arm 141 of the lever 113 (FIG. 19). A hinge pin 163 fits through the aligned openings to pivotally connect the lever 113 to the mount 183 and to securely hold the torsion spring 165 adjacent the lever. The lever mount 183 is secured to the housing 111 at the rearward end of the housing by two rivets, each indicated at 185 (FIG. 16), extending through the plateau 117 of the housing (FIGS. 13 and 15). A mounting post opening 187 in the lever mount 183 aligns with the rearward mounting post opening 179*a* of the housing 111. The opening 187 of the lever mount 183 is larger than the corresponding opening 179*a* of the housing 111 so that a mounting post can be easily peened to the housing when mounting the mechanism 101 on a notebook. The side arms 165*a*, 165*b* of the torsion spring 165 extend forward from the mounted lever 113 and engage an upper surface of the hinge plates 123*a*, 123*b*, to the side of each hinge plate finger 125 (FIGS. 17 and 18). The side arms 165*a*, 165*b* rest against longitudinal end edges of the hinge plates 123*a*, 123*b* adjacent the fingers 125.

When the lever 113 pivots to open the ring members 121*a*, 121*b*, the closed end 165*c* of the spring 165 engages the exterior of the lever and moves with the lever. The side arms 165*a*, 165*b* of the spring 165 remain stationery against inner sides of the housing 111. This creates a tension in the spring 165 that resists the lever movement and urges the lever 113 to pivot upward and inward to its vertical (closed and locked) position, as described for the first embodiment. An intermediate connector 153 is connected to the lever 113 at the closing arm 137 of the lever, above where the lever mounts on the lever mount 183, so the lever 113 pulls the travel bar 143 rearward during opening operation. When the lever 113 pivots to close the ring members 121*a*, 121*b*, it pushes the travel bar 143 forward. It can be seen that this operation of the travel bar 143 is opposite to that of the first embodiment. To account for this, the travel bar 143 is formed with reversed locking elements 145 (as compared to the orientation of the locking elements 45 of the first embodiment). Arcuate edges 147 and flat shoulders 149 of the locking elements 145 are on a forward side of the locking element in this embodiment. In generally all other regards, this embodiment operates the same as the first embodiment.

The torsion spring 165 is uniquely located outside the lever 113. This allows a traditional lever 113 with a unitary closing arm 137 to be used with the mechanism 101 while still using the torsion spring 165 to bias the lever to a closed and locked vertical position. The spring 165 is symmetrically oriented around the lever 113 for providing uniform force to the lever urging it to pivot upward and inward. The lever 113 moves to the closed and locked position and moves locking elements 145 to their position blocking pivoting movement of the hinge plates 123*a*, 123*b* when the ring members 121*a*, 121*b* close.

FIGS. 23-26 show a ring mechanism according to a third embodiment generally at 201. Parts of this mechanism corresponding to parts of the ring mechanism 1 of the first embodiment of FIGS. 1-12 are identified by the same reference numerals, plus "200," and parts corresponding to parts of the second embodiment of FIGS. 13-22 are identified by the same reference numerals, plus "100." With the exception of the modifications described below, it is understood that the mechanism 201 of this third embodiment is the same as the mechanism 101 of the second embodiment.

Figure 24:
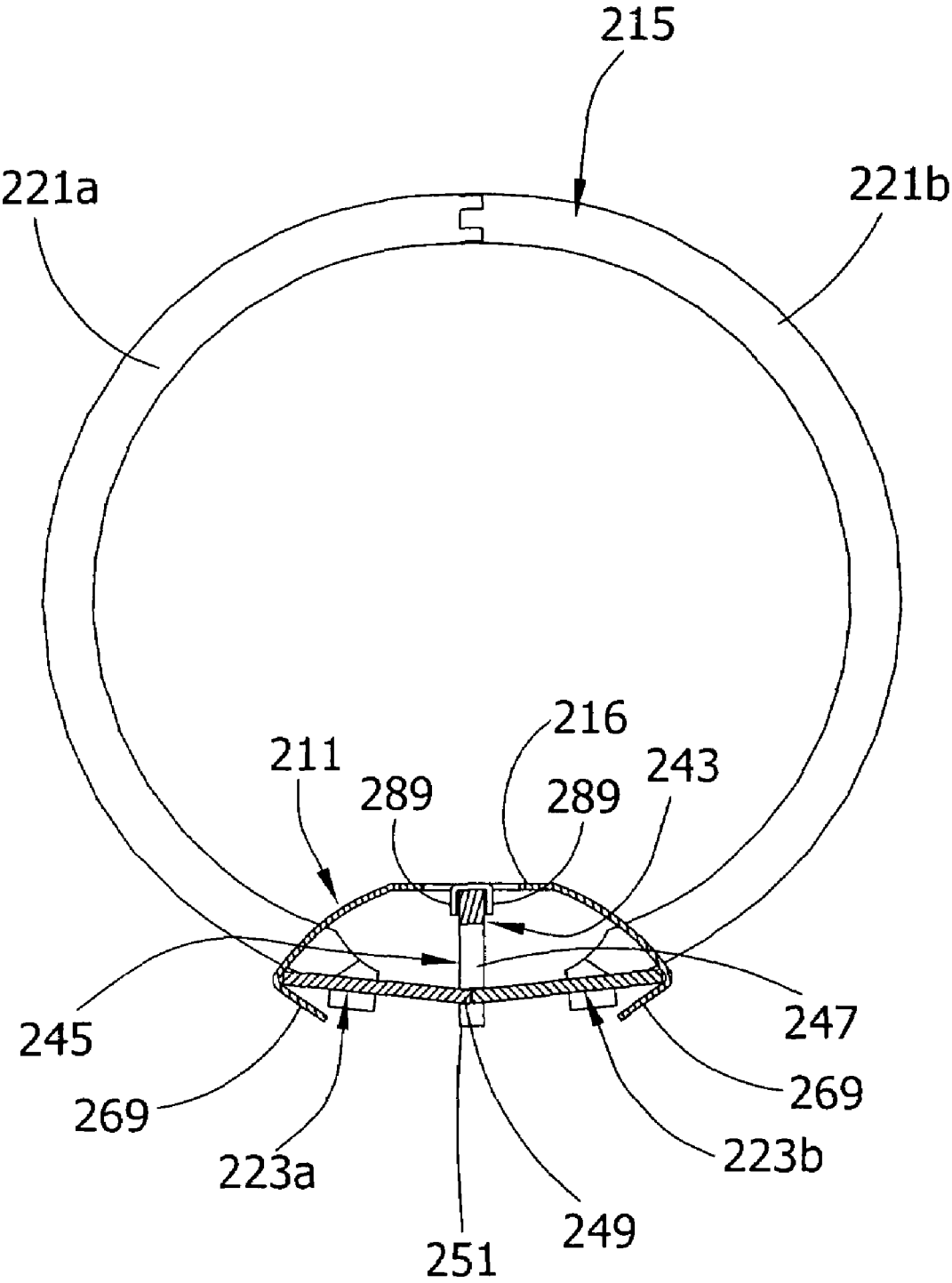
FIG. 24 is a cross section taken in the plane of line 24-24 of FIG. 23.

In this embodiment, a housing 211 is modified to include four pairs of bent under tabs (collectively forming a guide), each tab indicated at 289, spaced apart longitudinally along a plateau 216 of the housing. The tabs 289 form a broken channel within the housing 211 extending along the length of the housing between mounting post openings 279*a*, 279*b* of the housing. The tabs 289 are each rectangular in shape (FIGS. 25 and 26) and are formed directly from the housing 211 by cutting part of the housing plateau 216 to rectangular form and folding the cut part downward into the housing. The tabs 289 of each pair of tabs are oriented in a generally vertical position and in a generally parallel relation to each other (FIG. 24). They are also each parallel to a generally vertical plane containing a travel bar 243 of the mechanism 201. The shape and arrangement of the tabs can be other than described and shown in this embodiment without departing from the scope of the present invention.

Figure 25:
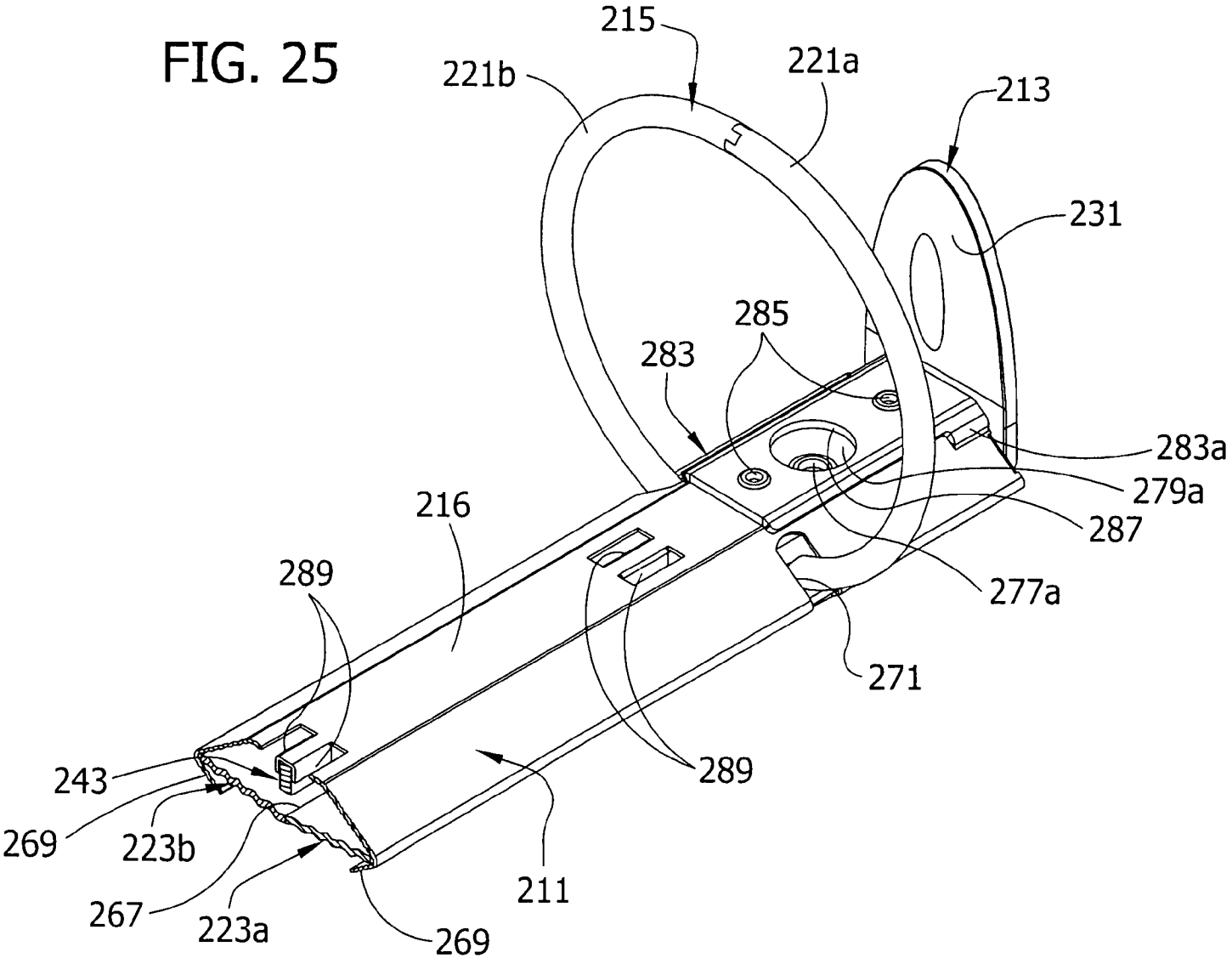
FIG. 25 is an enlarged and fragmentary top side perspective of the rearward end of the ring mechanism.
Figure 26:
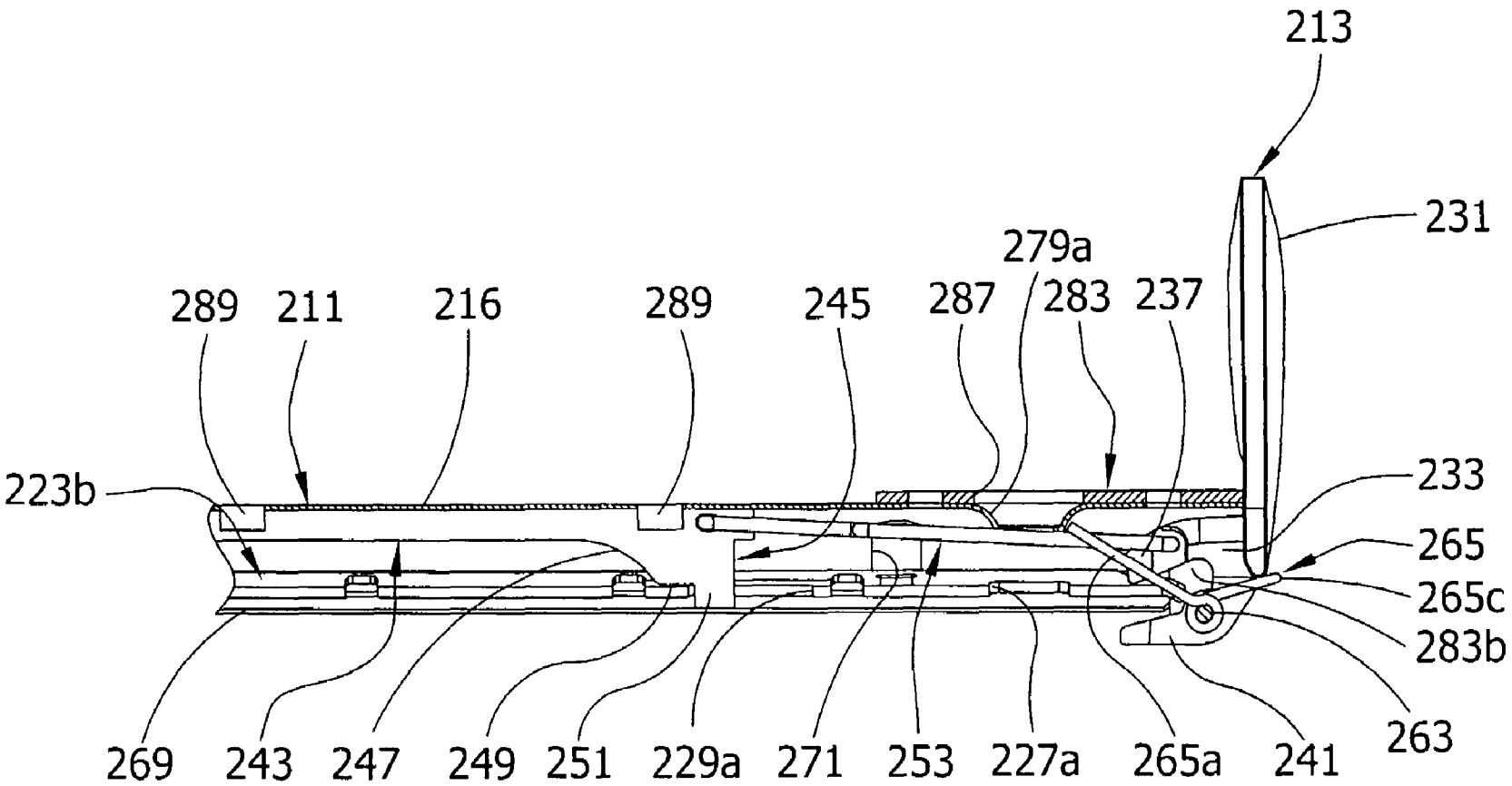
FIG. 26 is an enlarged and fragmentary side view of the rearward end of the ring mechanism with part of a housing broken away and parts of the mechanism removed to show internal construction.
Figure 27:
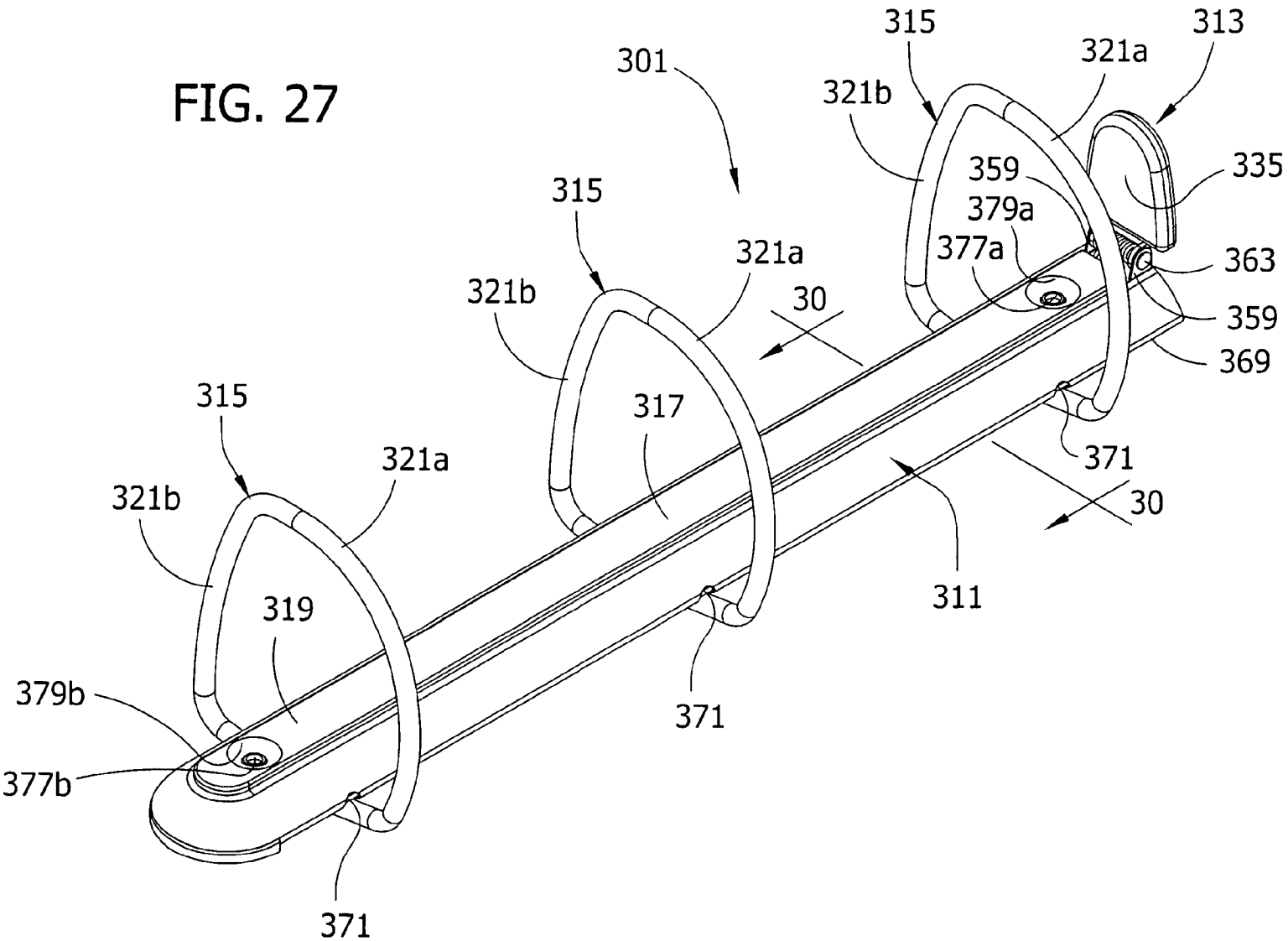
FIG. 27 is a top side perspective of a ring mechanism according to a fourth embodiment with ring members in the closed and locked position.

As shown in FIGS. 25 and 26, the travel bar 243 is positioned longitudinally of the housing 211 in its upright position between the two tabs 289 of each pair of tabs. As was described regarding the channels 19, 119 of the first and second embodiments, the tabs 289 of this embodiment loosely hold the travel bar 243 against lateral movement relative to the housing 211, support the travel bar in its upright position during movement, and guide the travel bar during operation.

FIGS. 27-36 show a ring mechanism according to a fourth embodiment generally at 301. Parts of this mechanism corresponding to parts of the ring mechanism 1 of the first embodiment of FIGS. 1-12 are identified by the same reference numerals, plus "300." The ring mechanism 301 of this embodiment is roughly similar to the ring mechanism 1 of the first embodiment, with the exception of a travel bar 343.

Figure 28:
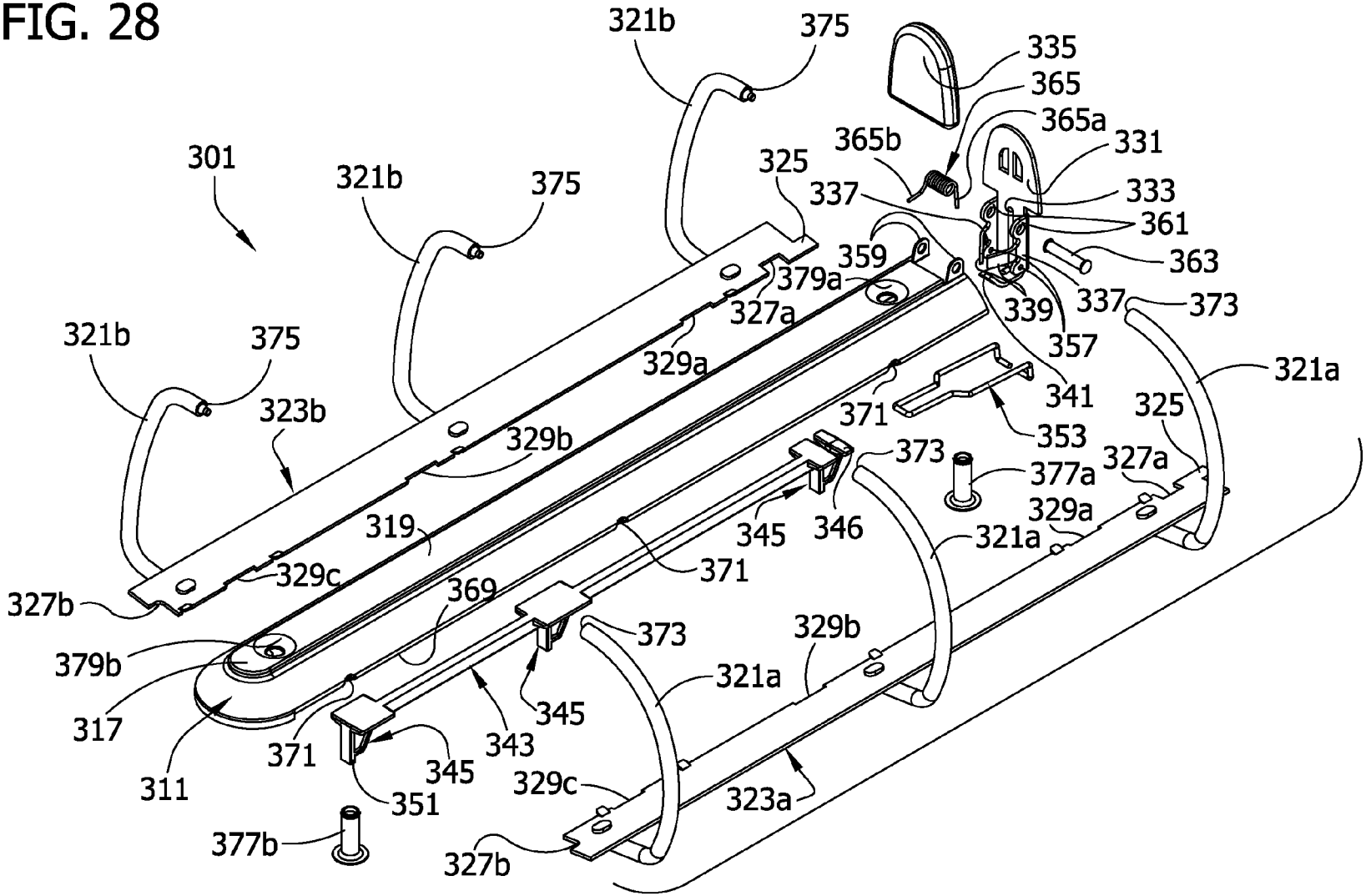
FIG. 28 is an exploded perspective of the ring mechanism.
Figures 29A, 29B:
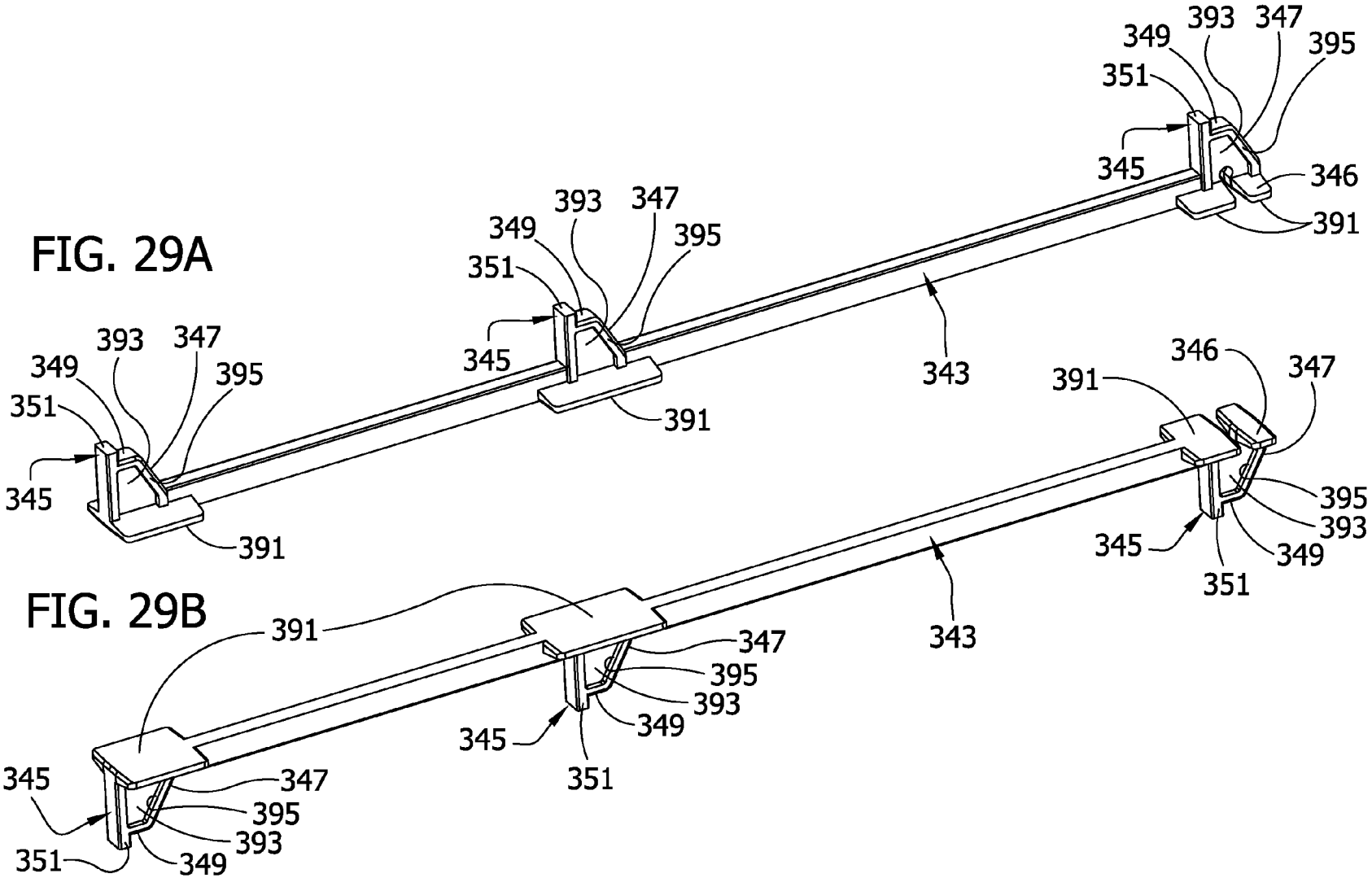
FIG. 29A is a bottom side perspective of a travel bar of the ring mechanism.
FIG. 29B is a top side perspective thereof.

As shown in FIGS. 28-29B, three tongues 391 are formed along a top edge of the travel bar 343. The tongues 391 are spaced longitudinally apart along the travel bar 343 with two tongues located toward respective end of the travel bar and one tongue located toward a center of the travel bar. Upper surfaces of the tongues 391 are generally co-planar and are oriented generally perpendicular to a plane containing the travel bar 343. One of the tongues 391 is bifurcated by a slot 355 adapted to receive a forward, closed end of an intermediate connector 353. An outwardly extending portion 346 (broadly, "a tab") of the bifurcated tongue 391 overlies a portion of the intermediate connector 353 adjacent the closed end thereof to thereby secure the intermediate connector to the travel bar 343. In other words, the slot 355 and outwardly extending portion 346 of the bifurcated tongue 391 cooperate to capture the closed end of the intermediate connector 353 and thereby operatively connect the travel bar 343 to a lever 313. The tongues 391 are formed as one piece with the travel bar 343. But tongues may be formed separate from a travel bar and attached thereto. In the illustrated embodiment, the travel bar 343 is made of plastic and formed by a mold process. It is understood, however, that the travel bar could be made from other materials and formed from other processes.

Figure 30:
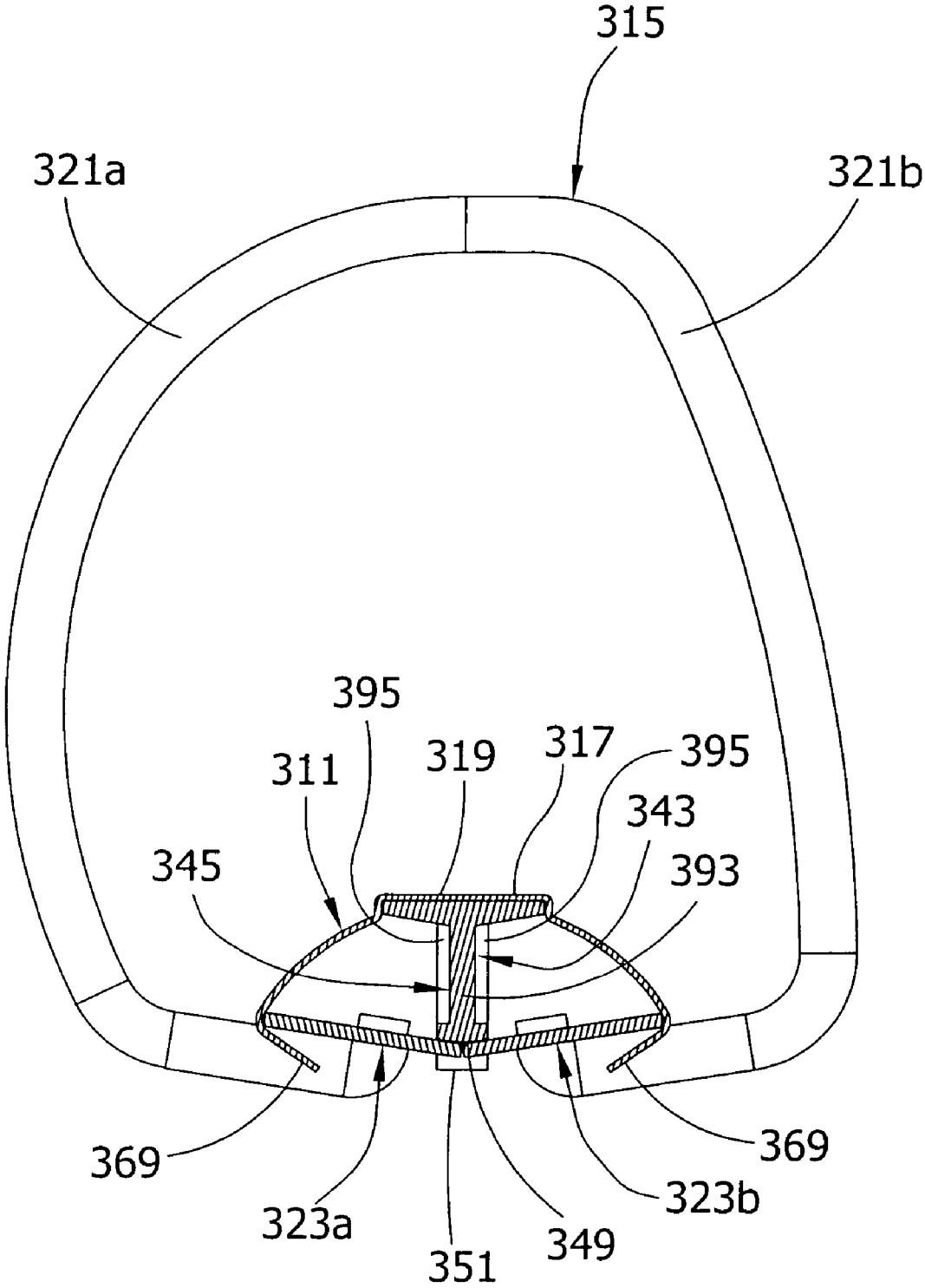
FIG. 30 is a cross section taken in the plane of line 30-30 of FIG. 27.
Figure 31:
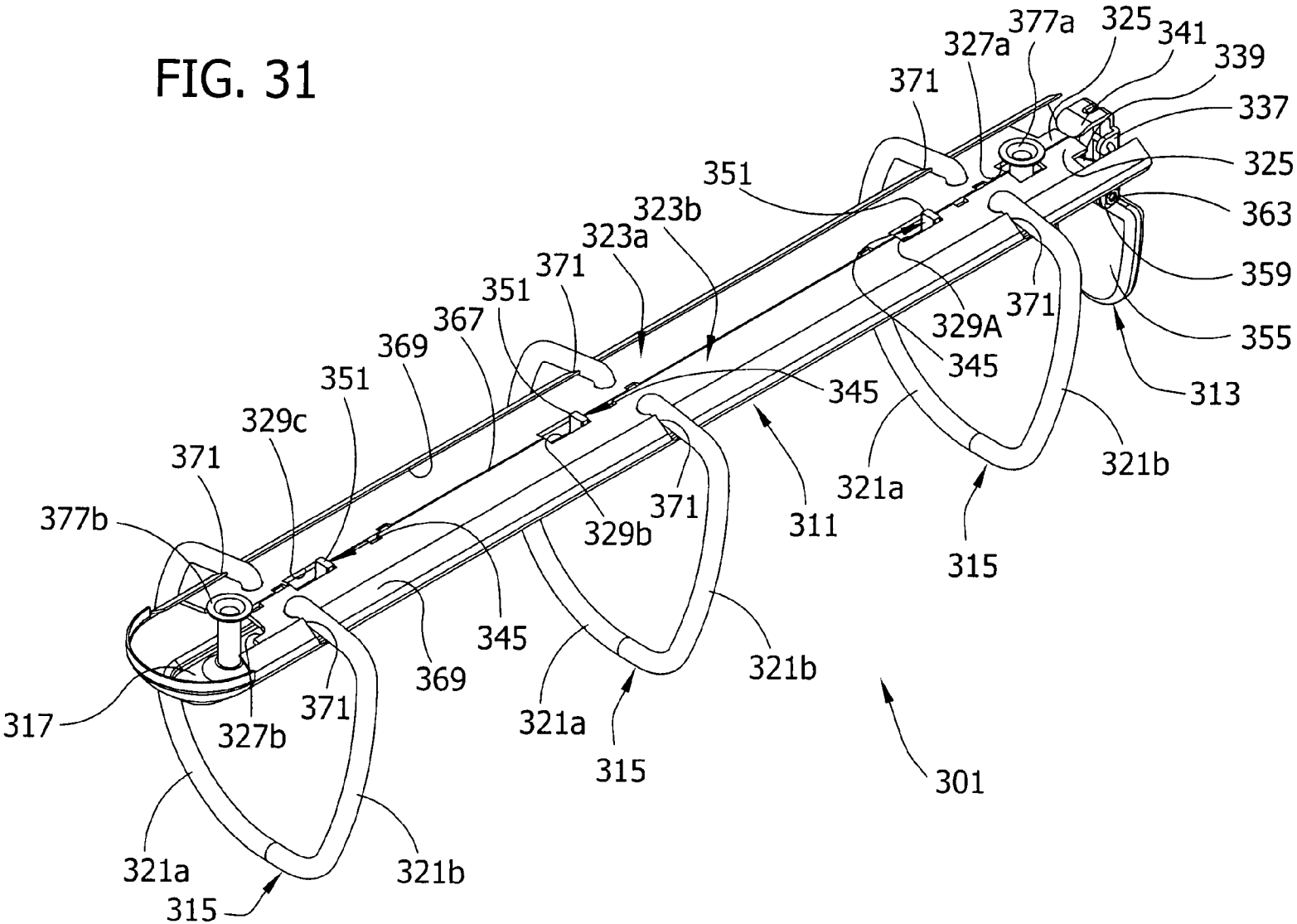
FIG. 31 is a bottom side perspective of the ring mechanism of FIG. 27.
Figure 32:
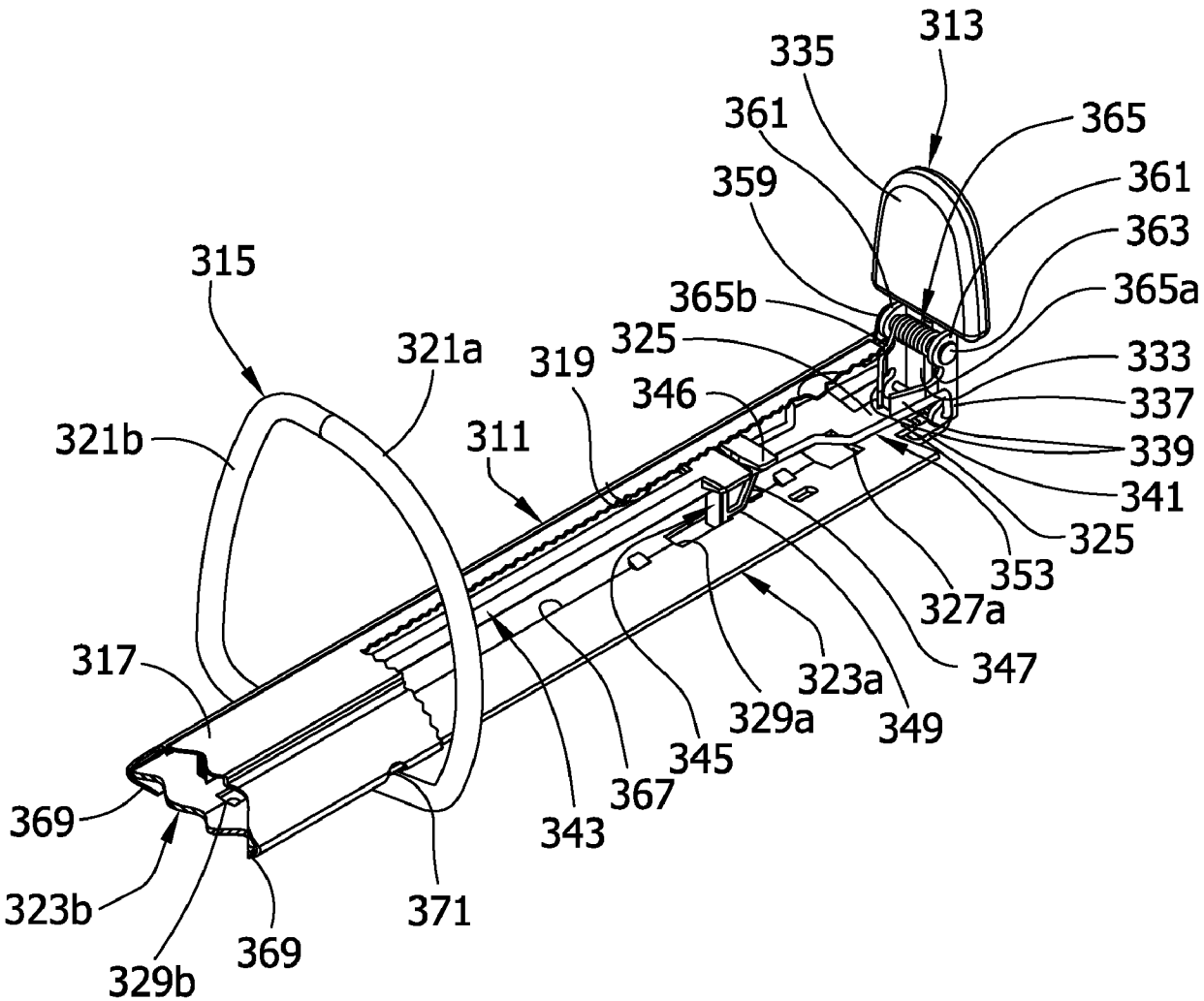
FIG. 32 is an enlarged and fragmentary top side perspective of the rearward end of the ring mechanism of FIG. 27 with part of a housing broken away and ring members removed.
Figure 33:
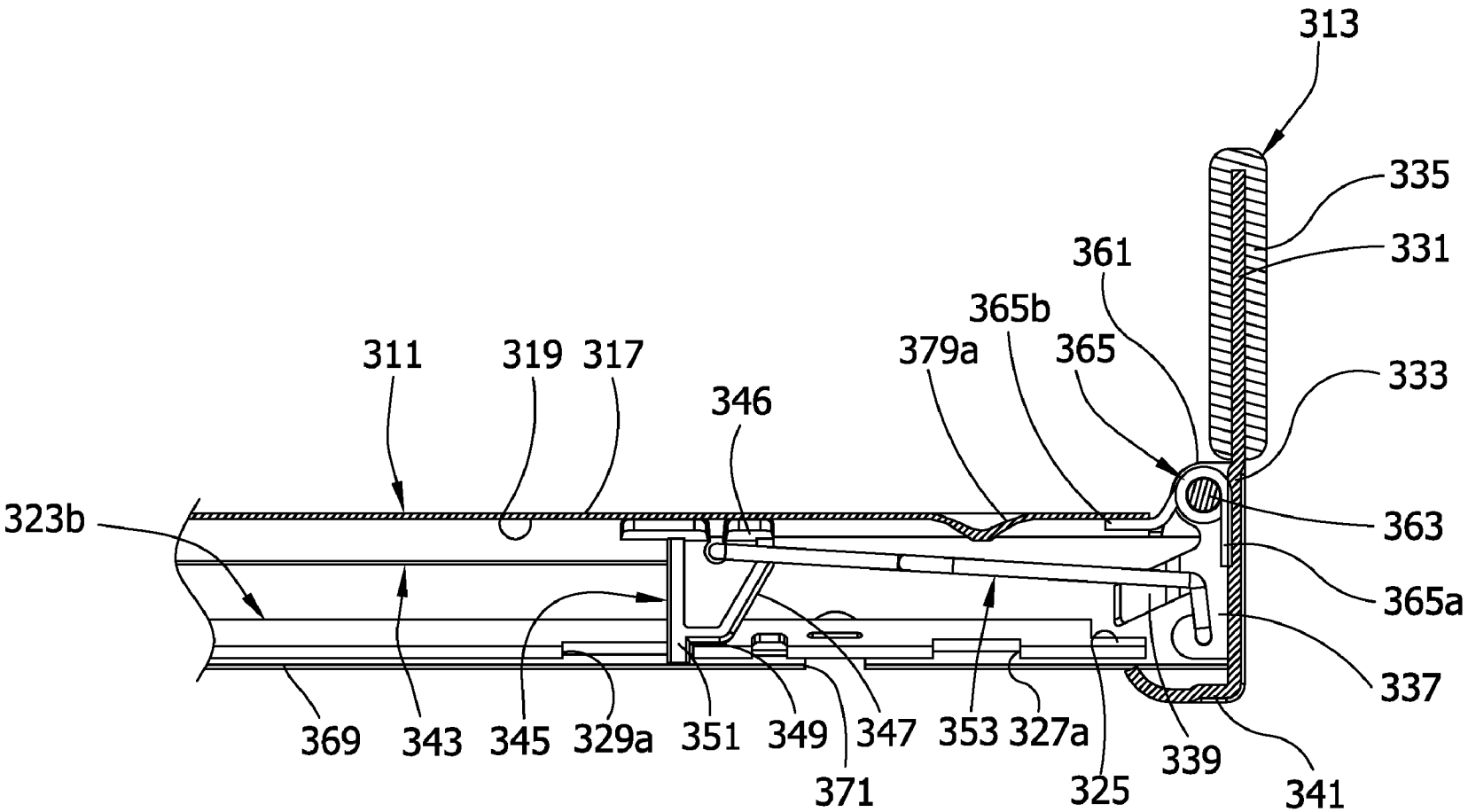
FIG. 33 is an enlarged and fragmentary side view of the rearward portion thereof with a lever shown in section and a hinge plate and ring members removed.
Figure 34:
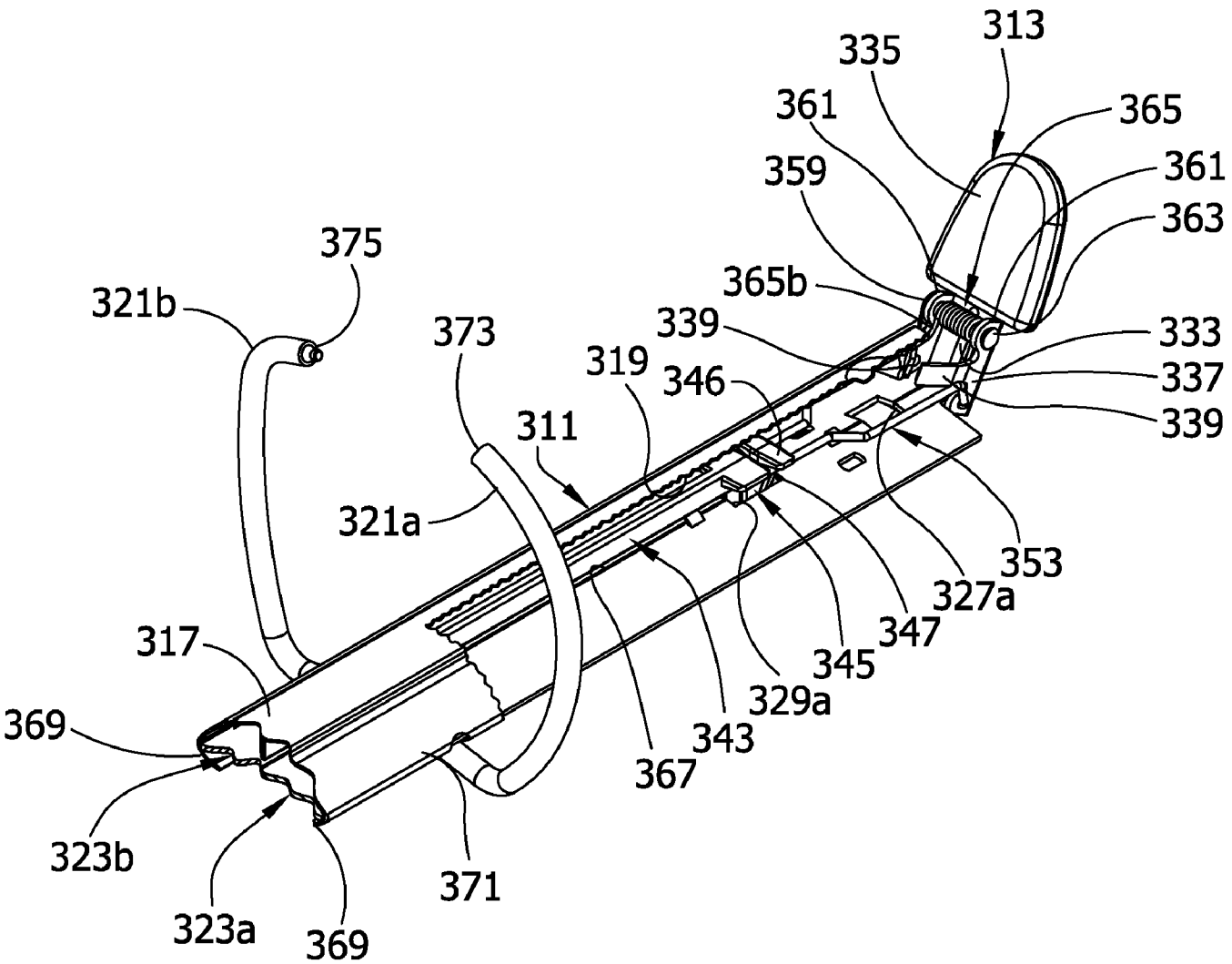
FIG. 34 is an enlarged and fragmentary top side perspective similar to FIG. 32 with the ring members in the open position.
Figure 35:
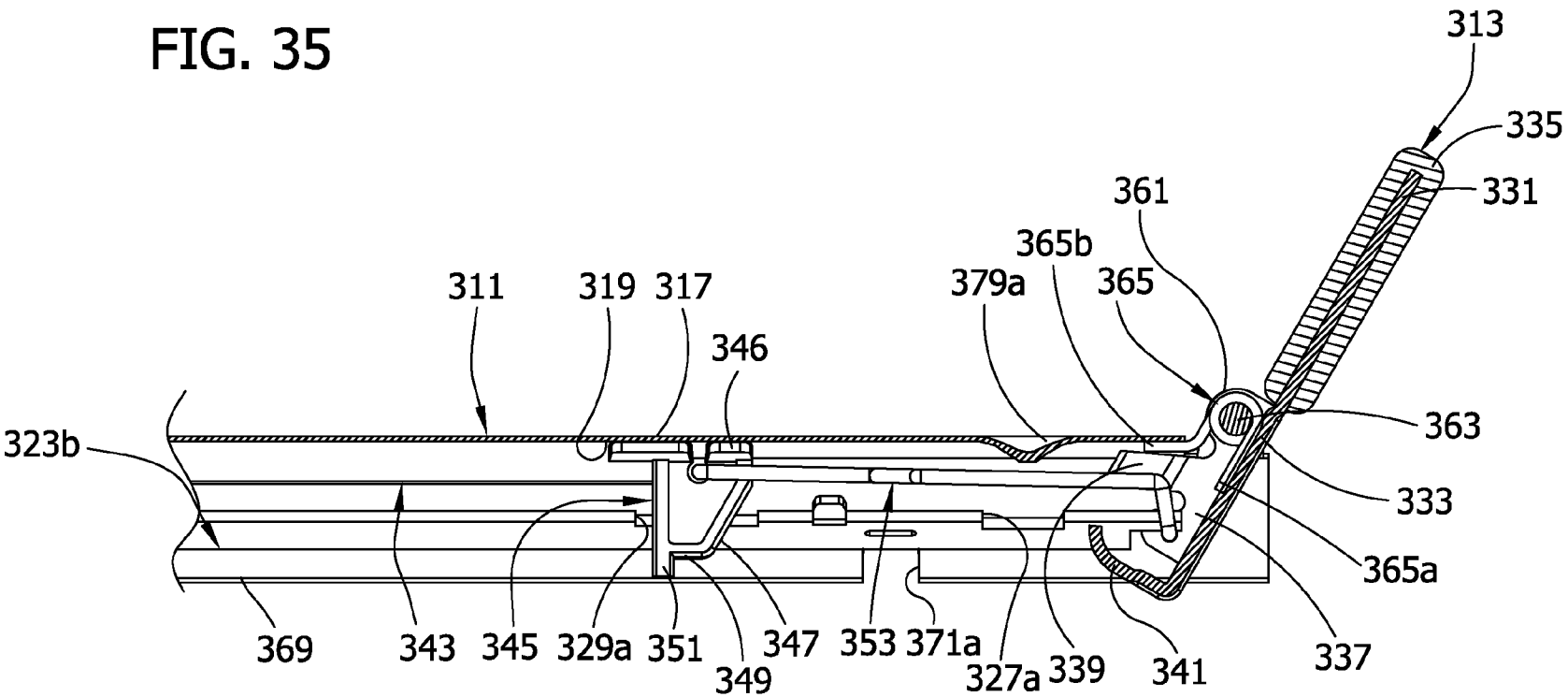
FIG. 35 is an enlarged and fragmentary side view similar to FIG. 32 with the ring mechanism in the open position.
Figure 36:
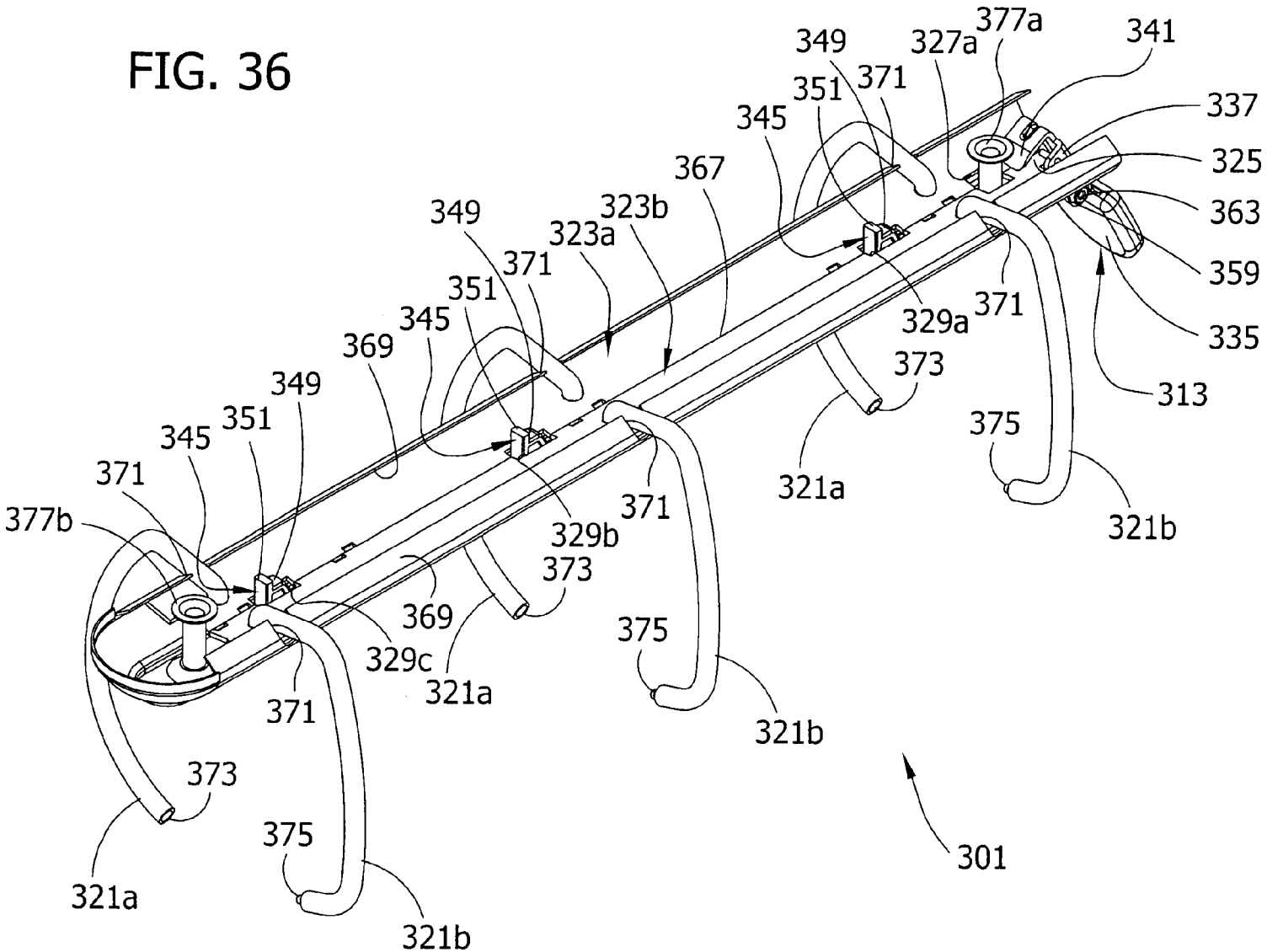
FIG. 36 is a bottom side perspective of the ring mechanism with the ring members in the open position.

As shown in FIGS. 30, 32, and 33, the flats 391 fit within a raised channel 319 of a housing 311 for movement within the channel in a longitudinal direction of the housing. The channel 319 is substantially the width of a plateau 317 of the housing 311 and supports the tongues 391 against lateral movement of the housing. As in the previous embodiment, the channel 319 holds the travel bar 343 in proper alignment within the housing 311 as it moves and helps prevent the travel bar from canting within the housing during operation.

Referring again to FIGS. 28-29B, locking elements 345 of the travel bar 343 each include a gusset 393 having a thick border 395. The gussets 393 provide strengthened locking elements 345 for blocking pivoting movement of hinge plates 323*a*, 323*b*. All other aspects of the ring mechanism 301, including operation, are substantially the same as described for the ring mechanism 1 of the first embodiment.

Components of the ring mechanisms of the embodiments described herein are made of a suitable rigid material, such as a metal (e.g. steel). But mechanisms having components made of a nonmetallic material, specifically including a plastic, do not depart from the scope of this invention. For instance, the travel bar 343 of the fourth embodiment is preferably a molded, plastic piece.

When introducing elements of the embodiments, the articles "a", "an", "the" and "said" are intended to mean that there are one or more of the elements. The terms "comprising", "including" and "having," and variations thereof, are intended to be inclusive and mean that there may be additional elements other than the listed elements. Moreover, the use of "up" and "down" and variations of these terms is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring mechanism for retaining loose-leaf pages, the mechanism comprising:

a housing having a guide;

hinge plates supported by the housing for pivoting movement relative to the housing, the hinge plates pivoting through a co-planar position;

rings for holding loose-leaf pages, each ring including a first ring member and a second ring member, the first ring member being mounted on a first hinge plate and moveable with the pivoting motion of the first hinge plate relative to the second ring member between a closed position and an open position, in the closed position the two ring members forming a substantially continuous, closed loop for allowing loose-leaf pages retained by the rings to be moved along the rings from one ring member to the other, and in the open position the two ring members forming a discontinuous, open loop for adding or removing loose-leaf pages from the rings;

a travel bar restrained by the guide for longitudinal movement relative to the housing between a locked position and an unlocked position, the travel bar including at least one locking element formed as one piece with the travel bar, the locking element being adapted to block movement of the hinge plates in the locked position of the travel bar, wherein the guide is elongate in a direction extending lengthwise of the housing.

2. A ring mechanism as set forth in claim 1 wherein the travel bar apart from the locking element has thin edges and broader major surfaces, the guide being sized to securely receive a thin edge of the travel bar therein.

3. A ring mechanism as set forth in claim 2 wherein the guide has a width and a length, the length of the guide being less than a length of the housing.

4. A ring mechanism as set forth in claim 3 wherein the housing includes a plateau, the guide being formed as a longitudinal channel in the plateau.

5. A ring mechanism as set forth in claim 1 further comprising at least one tongue attached to the travel bar and received in the guide.

6. A ring mechanism as set forth in claim 1 wherein the guide comprises multiple tabs bent downward from an upper surface of the housing.

7. A ring mechanism as set forth in claim 1 wherein the travel bar engages the hinge plates both when the ring members are in the closed position and when the ring members are in the open position, the hinge plates supporting the travel bar within the guide in both positions.

8. A ring mechanism as set forth in claim 1 further comprising an actuator mounted for pivoting movement relative to the housing and an intermediate connector, the intermediate connector being pivotally connected to the actuator and pivotally connected to the travel bar such that pivoting movement of the actuator results in longitudinal movement of the travel bar relative to the housing.

9. A ring mechanism as set forth in claim 8 wherein the intermediate connected comprises a wire.

10. A ring mechanism as set forth in claim 1 wherein the housing has a plateau and the guide comprises a longitudinal channel formed in the plateau.

11. A ring mechanism as set forth in claim 10 wherein the travel bar has a flat shape and an upper edge of the travel bar is received in the channel.

12. A ring mechanism for retaining loose-leaf pages, the mechanism comprising:

a housing having a longitudinal axis, a lateral axis, and a top portion;

hinge plates supported by the housing for pivoting movement relative to the housing, the hinge plates pivoting through a co-planar position;

rings for holding loose-leaf pages, each ring including a first ring member and a second ring member, the first ring member being mounted on a first hinge plate and moveable with the pivoting motion of the first hinge plate relative to the second ring member between a closed position and an open position, in the closed position the two ring members forming a substantially continuous, closed loop for allowing loose-leaf pages retained by the rings to be moved along the rings from one ring member to the other, and in the open position the two ring members forming a discontinuous, open loop for adding or removing loose-leaf pages from the rings;

a travel bar restrained by the top portion of the housing for movement relative to the housing in a direction along the longitudinal axis of the housing wherein the top portion of the housing includes a guide for receiving part of the travel bar therein and wherein the guide is elongate in a direction extending lengthwise of the housing; and an actuator moveable relative to the housing for moving the rings between their open and closed positions, the actuator comprising an opening arm positioned under the hinge plates to pivot the honge plates to open the rings during movement of the actuator relative to the housing to open the rings.

13. A ring mechanism as set forth in claim 12 wherein the travel bar comprises at least one tongue.

14. A ring mechanism as set forth in claim 12 wherein the travel bar engages both the top portion of the housing and the hinge plates when the ring members are in the closed position and when the ring members are in the open position.

15. A ring mechanism as set forth in claim 12 further comprising an intermediate connector, the intermediate connector being pivotally connected to the actuator and pivotally connected to the travel bar.

16. A ring mechanism as set forth in claim 15 wherein the intermediate connected comprises a wire.

17. A ring mechanism as set forth in claim 12 wherein the hinge plates are generally rectangular in shape.

18. A ring mechanism as set forth in claim 12 wherein the hinge plates each have inner and outer longitudinal edge margins, the hinge plates engaging one another at their inner longitudinal edge margins.

19. A ring mechanism as set forth in claim 12 wherein the travel bar slides on the top portion of the housing when the travel bar moves along the longitudinal axis of the housing.

20. A ring mechanism as set forth in claim 1 further comprising an actuator moveable relative to the housing for moving the rings between their open and closed positions, the actuator comprising an opening arm positioned under the hinge plates to pivot the hinge plates to open the rings during movement of the actuator relative to the housing to open the rings.

* * * * *